US009108292B2

(12) United States Patent
Shimano et al.

(10) Patent No.: US 9,108,292 B2
(45) Date of Patent: Aug. 18, 2015

(54) METHOD OF OBTAINING A SLIDING DISTANCE DISTRIBUTION OF A DRESSER ON A POLISHING MEMBER, METHOD OF OBTAINING A SLIDING VECTOR DISTRIBUTION OF A DRESSER ON A POLISHING MEMBER, AND POLISHING APPARATUS

(71) Applicant: EBARA CORPORATION, Tokyo (JP)

(72) Inventors: Takahiro Shimano, Tokyo (JP); Mutsumi Tanikawa, Tokyo (JP); Hisanori Matsuo, Tokyo (JP); Kuniaki Yamaguchi, Tokyo (JP); Katsuhide Watanabe, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/184,655

(22) Filed: Feb. 19, 2014

(65) Prior Publication Data

US 2014/0342642 A1 Nov. 20, 2014

(30) Foreign Application Priority Data

Feb. 22, 2013 (JP) ..... 2013-033660

(51) Int. Cl.
*B24B 53/017* (2012.01)
*B24B 53/02* (2012.01)
*B24B 53/00* (2006.01)

(52) U.S. Cl.
CPC ..... *B24B 53/005* (2013.01); *B24B 53/017* (2013.01); *B24B 53/02* (2013.01)

(58) Field of Classification Search
CPC .... B24B 53/005; B24B 53/02; B24B 53/017; B24B 53/00
USPC ..... 451/5, 56, 72, 443, 444, 21
See application file for complete search history.

(56) References Cited

U.S. PATENT DOCUMENTS

2002/0164932 A1* 11/2002 Kamimura et al. ..... 451/56
2010/0081361 A1 4/2010 Fukuda et al.
2012/0270477 A1* 10/2012 Nangoy et al. ..... 451/56

FOREIGN PATENT DOCUMENTS

JP 10-000550 1/1998
JP 2010-076049 8/2010
JP 2012-009692 1/2012

OTHER PUBLICATIONS

Chen et al, "Operational Aspects of Chemical Mechanical Polishing Polish Pad Profile Optimization", Journal of the Electrochemical Society, 2000, 147(10), 3922-3930.

*Primary Examiner* — Robert Rose
(74) *Attorney, Agent, or Firm* — Baker & Hostetler LLP

(57) ABSTRACT

The method includes: calculating an increment of a sliding distance of a dresser by multiplying a relative speed between the dresser and a polishing member by a contact time between them; correcting the increment of the sliding distance by multiplying the calculated increment of the sliding distance by at least one correction coefficient; calculating the sliding distance by repeatedly adding the corrected increment of the sliding distance to the sliding distance according to elapse of time; and producing the sliding-distance distribution of the dresser from the obtained sliding distance and a position of a sliding-distance calculation point. The at least one correction coefficient includes an unevenness correction coefficient provided for the sliding-distance calculation point. The unevenness correction coefficient is a correction coefficient that allows a profile of the polishing member to reflect a difference between an amount of scraped material of the polishing member in its raised portion and an amount of scraped material of the polishing member in its recess portion.

26 Claims, 18 Drawing Sheets

ORTHOGONALITY INDEX = 0

ORTHOGONALITY INDEX = 1

ORTHOGONALITY INDEX = 0.5

METHOD OF OBTAINING A SLIDING DISTANCE DISTRIBUTION OF A DRESSER ON A POLISHING MEMBER, METHOD OF OBTAINING A SLIDING VECTOR DISTRIBUTION OF A DRESSER ON A POLISHING MEMBER, AND POLISHING APPARATUS

CROSS REFERENCE TO RELATED APPLICATION

This document claims priority to Japanese Patent Application Number 2013-033660 filed Feb. 22, 2013, the entire contents of which are hereby incorporated by reference.

BACKGROUND OF THE INVENTION

1. Field of the Invention

The present invention relates to a method of obtaining a profile of a polishing member used in a polishing apparatus which polishes a surface of a workpiece, such as a wafer, and more particularly relates to a method of obtaining a sliding-distance distribution of a dresser on the polishing member by a simulation of a dressing operation.

The present invention further relates to a method of obtaining a sliding vector distribution of a dresser which can be used for an evaluation of a dressing operation of a polishing member.

Furthermore, the present invention relates to a polishing apparatus which can perform the above-mentioned methods.

2. Description of the Related Art

As a more highly integrated structure of a semiconductor device has recently been developed, interconnects of a circuit become finer and dimensions of the integrated device decrease. Thus, it becomes necessary to polish a wafer having films (e.g., metal film) on its surface to planarize the surface of the wafer. One example of the planarization technique is a polishing process performed by a chemical-mechanical polishing (CMP) apparatus. This chemical-mechanical polishing apparatus includes a polishing member (e.g., a polishing cloth or polishing pad) and a holder (e.g., a top ring, a polishing head, or a chuck) for holding a workpiece, such as a wafer, to be polished. The polishing apparatus of this type is operable to press a surface (to be polished) of the workpiece against a surface of the polishing member and cause relative movement between the polishing member and the workpiece while supplying a polishing liquid (e.g., an abrasive liquid, a chemical liquid, slurry, pure water) between the polishing member and the workpiece to thereby polish the surface of the workpiece to a flat finish. Such a polishing process performed by the chemical-mechanical polishing apparatus yields a good polishing result due to a chemical polishing action and a mechanical polishing action.

Foam resin or nonwoven cloth is typically used as a material of the polishing member used in such chemical-mechanical polishing apparatus. Fine irregularities (or asperity) are formed on the surface of the polishing member and these fine irregularities serve as chip pockets that can effectively prevent clogging and can reduce polishing resistance. However, continuous polishing operations for the workpieces with use of the polishing member can crush the fine irregularities on the surface of the polishing member, thus causing a lowered polishing rate. Thus, a dresser, having a number of abrasive grains, such as diamond particles, electrodeposited thereon, is used to dress (condition) the surface of the polishing member to regenerate fine irregularities on the surface of the polishing member.

Examples of the method of dressing the polishing member include a method using a dresser (a large-diameter dresser) that is equal to or larger than a polishing area used in polishing of the workpiece with the polishing member and a method using a dresser (a small-diameter dresser) that is smaller than the polishing area used in polishing of the workpiece with the polishing member. In the method of using the large-diameter dresser, a dressing operation is performed, for example, by pressing a dressing surface, on which the abrasive grains are electrodeposited, against the rotating polishing member, while rotating the dresser in a fixed position. In the method of using the small-diameter dresser, a dressing operation is performed, for example, by pressing a dressing surface against the rotating polishing member, while moving the rotating dresser (e.g., reciprocation or oscillation in an arc or linearly). In both methods in which the polishing member is rotated during dressing, the polishing area on the surface of the polishing member for use in the actual polishing is an annular region centered on a rotational axis of the polishing member.

During dressing of the polishing member, the surface of the polishing member is scraped away in a slight amount. Therefore, if dressing is not performed appropriately, unwanted undulation is formed on the surface of the polishing member, causing a variation in a polishing rate within the polished surface of the workpiece. Such a variation in the polishing rate can be a possible cause of polishing failure. Therefore, it is necessary to perform dressing of the polishing member in a manner as not to generate the undesired undulation on the surface of the polishing member. One approach to avoid the variation in the polishing rate is to perform the dressing operation under appropriate dressing conditions including an appropriate rotational speed of the polishing member, an appropriate rotational speed of the dresser, an appropriate dressing load, and an appropriate moving speed of the dresser (in the case of using the small-diameter dresser).

The dressing conditions are adjusted based on a profile (i.e., a cross-sectional shape of the polishing surface) of the polishing member that has been dressed. In order to obtain the profile of the polishing member, it is necessary to actually perform the dressing operation of the polishing member and measure thicknesses of the polishing member (or surface heights of the polishing member) at plural measuring points with use of a thickness measuring device, such as a micrometer. However, obtaining the profile of the polishing member by way of the actual measurement is a time-consuming operation and increases costs.

Indexes for evaluating the dressing of the polishing member may include the profile and a cutting rate of the polishing member. The profile of the polishing member represents a cross-sectional shape along the radial direction of the polishing surface of the polishing member. The cutting rate of the polishing member represents an amount (or a thickness) of the polishing member that has been scraped away per unit time by the dresser. The profile and the cutting rate can be estimated by a sliding-distance distribution along the radial direction of the polishing member.

SUMMARY OF THE INVENTION

As shown in Japanese laid-open patent publication No. 2010-76049, there is a method of obtaining the profile of the polishing member by a pad dressing simulation without actually dressing the polishing member. A first object of the present invention is to provide a method of obtaining a more highly accurate profile of the polishing member by an improved pad dressing simulation.

Furthermore, a second object of the present invention is to provide a method of producing a novel index for evaluating the dressing of the polishing member.

The first aspect of the present invention provides a method of obtaining a sliding-distance distribution of a dresser sliding on a polishing member for polishing a substrate. The method comprises; calculating a relative speed between the dresser and the polishing member at a predetermined sliding-distance calculation point on the polishing member; calculating an increment of a sliding distance of the dresser at the sliding-distance calculation point by multiplying the relative speed by a contact time during which the dresser contacts the polishing member at the sliding-distance calculation point; correcting the increment of the sliding distance by multiplying the calculated increment of the sliding distance by at least one correction coefficient; updating the sliding distance by adding the corrected increment of the sliding distance to a current sliding distance at the sliding-distance calculation point; and producing a sliding-distance distribution of the dresser from the updated sliding distance and a position of the sliding-distance calculation point, wherein the at least one correction coefficient includes an unevenness correction coefficient provided for the sliding-distance calculation point, wherein the unevenness correction coefficient is a correction coefficient that allows a profile of the polishing member to reflect a difference between an amount of scraped material of the polishing member in its raised portion and an amount of scraped material of the polishing member in its recess portion, and wherein the correcting of the increment of the sliding distance comprises correcting the increment of the sliding distance by multiplying the increment of the sliding distance by the unevenness correction coefficient.

In a preferred aspect of the present invention, the unevenness correction coefficient is determined by: calculating an average of sliding distances at plural sliding-distance calculation points that are in contact with the dresser; calculating a difference by subtracting the average from the sliding distance at the predetermined sliding-distance calculation point that is in contact with the dresser; and inputting the difference into a predetermined function.

In a preferred aspect of the present invention, the at least one correction coefficient further includes a predetermined friction correction coefficient, and the correcting of the increment of the sliding distance further comprises correcting the corrected increment of the sliding distance by multiplying the corrected increment of the sliding distance by the friction correction coefficient, if the dresser contacts the polishing member at the sliding-distance calculation point predetermined times or more while steps from the calculating of the relative speed to the correcting of the increment of the sliding distance are repeated.

In a preferred aspect of the present invention, the at least one correction coefficient further includes a substrate sliding-distance correction coefficient, which is determined by: calculating a sliding distance of the substrate on the polishing member at the sliding-distance calculation point; calculating a ratio of the sliding distance of the substrate to the sliding distance of the dresser at the sliding-distance calculation point; and inputting the ratio into a predetermined function.

In a preferred aspect of the present invention, the method further comprises calculating a surface dressing ratio representing a ratio of a dresser contact area to a substrate contact area of the polishing member.

In a preferred aspect of the present invention, the method further comprises determining dressing conditions that allow the surface dressing ratio to be larger than or equal to a predetermined target value.

In a preferred aspect of the present invention, the method further comprises calculating an index indicating a variation in the sliding distance of the dresser in a substrate contact area of the polishing member.

In a preferred aspect of the present invention, the method further comprises determining dressing conditions that allow the index, indicating the variation in the sliding distance of the dresser, to be less than or equal to a predetermined target value.

The second aspect of the present invention provides a polishing apparatus comprising: a polishing table configured to support a polishing member, a substrate holder configured to press the substrate against the polishing member to polish the substrate; a dresser configured to dress the polishing member; and a dressing monitoring device configured to obtain a sliding-distance distribution of the dresser which slides on the polishing member, the dressing monitoring device being configured to calculate a relative speed between the dresser and the polishing member at a predetermined sliding-distance calculation point on the polishing member, calculate an increment of a sliding distance of the dresser at the sliding-distance calculation point by multiplying the relative speed by a contact time during which the dresser contacts the polishing member at the sliding-distance calculation point, correct the increment of the sliding distance by multiplying the calculated increment of the sliding distance by at least one correction coefficient, update the sliding distance by adding the corrected increment of the sliding distance to a current sliding distance at the sliding-distance calculation point, and produce a sliding-distance distribution of the dresser from the updated sliding distance and a position of the sliding-distance calculation point, wherein the at least one correction coefficient includes an unevenness correction coefficient provided for the sliding-distance calculation point, wherein the unevenness correction coefficient is a correction coefficient that allows a profile of the polishing member to reflect a difference between an amount of scraped material of the polishing member in its raised portion and an amount of scraped material of the polishing member in its recess portion, and wherein the dressing monitoring device is configured to correct the increment of the sliding distance by multiplying the increment of the sliding distance by the unevenness correction coefficient.

In a preferred aspect of the present invention, the dressing monitoring device is configured to determine the unevenness correction coefficient by: calculating an average of sliding distances at plural sliding-distance calculation points that are in contact with the dresser; calculating a difference by subtracting the average from the sliding distance at the predetermined sliding-distance calculation point that is in contact with the dresser, and inputting the difference into a predetermined function.

In a preferred aspect of the present invention, the at least one correction coefficient further includes a predetermined friction correction coefficient, and the dressing monitoring device is configured to correct the corrected increment of the sliding distance by multiplying the corrected increment of the sliding distance by the friction correction coefficient, if the dresser contacts the polishing member at the sliding-distance calculation point predetermined times or more while steps from the calculating of the relative speed to the correcting of the increment of the sliding distance are repeated.

In a preferred aspect of the present invention, the at least one correction coefficient further includes a substrate sliding-distance correction coefficient, and the dressing monitoring device is configured to determine the substrate sliding-distance correction coefficient by: calculating a sliding distance of the substrate on the polishing member at the sliding-distance calculation point; calculating a ratio of the sliding distance of the substrate to the sliding distance of the dresser at the sliding-distance calculation point; and inputting the ratio into a predetermined function.

In a preferred aspect of the present invention, the dressing monitoring device is configured to calculate a surface dressing ratio representing a ratio of a dresser contact area to a substrate contact area of the polishing member.

In a preferred aspect of the present invention, the dressing monitoring device is configured to determine dressing conditions that allow the surface dressing ratio to be larger than or equal to a predetermined target value.

In a preferred aspect of the present invention, the dressing monitoring device is configured to calculate an index indicating a variation in the sliding distance of the dresser in a substrate contact area of the polishing member.

In a preferred aspect of the present invention, the dressing monitoring device is configured to determine dressing conditions that allow the index, indicating the variation in the sliding distance of the dresser, to be less than or equal to a predetermined target value.

The third aspect of the present invention provides a method of obtaining a sliding vector distribution of a dresser which slides on a polishing member for polishing a substrate. The method comprises: calculating a relative speed between the dresser and the polishing member at a predetermined sliding-distance calculation point on the polishing member; calculating an increment of a sliding distance of the dresser at the sliding-distance calculation point by multiplying the relative speed by a contact time during which the dresser contacts the polishing member at the sliding-distance calculation point; correcting the increment of the sliding distance by multiplying the calculated increment of the sliding distance by at least one correction coefficient; calculating a sliding direction of the dresser at the sliding-distance calculation point; selecting one of preset plural sliding directions based on the calculated sliding direction; producing a sliding vector by adding the corrected increment of the sliding distance to a current sliding distance associated with the selected direction at the sliding-distance calculation point to update the sliding distance; and producing the sliding vector distribution of the dresser from the sliding vector and a position of the sliding-distance calculation point.

In a preferred aspect of the present invention, the method further comprises calculating an index which indicates a variation in the sliding vector in a substrate contact area of the polishing member.

In a preferred aspect of the present invention, the method further comprises determining dressing conditions that allow the index, indicating the variation in the sliding vector, to be less than or equal to a predetermined target value.

In a preferred aspect of the present invention, the method further comprises calculating an index which indicates an orthogonality of sliding vectors in the substrate contact area of the polishing member.

In a preferred aspect of the present invention, the method further comprises determining the dressing conditions that allow the index, indicating the orthogonality of the sliding vectors, to be larger than or equal to a predetermined target value.

The fourth aspect of the present invention provides a polishing apparatus comprising: a polishing table configured to support a polishing member; a substrate holder configured to press the substrate against the polishing member to polish the substrate; a dresser configured to dress the polishing member, and a dressing monitoring device configured to obtain a sliding vector distribution of the dresser which slides on the polishing member, the dressing monitoring device being configured to calculate a relative speed between the dresser and the polishing member at a predetermined sliding-distance calculation point on the polishing member, calculate an increment of a sliding distance of the dresser at the sliding-distance calculation point by multiplying the relative speed by a contact time during which the dresser contacts the polishing member at the sliding-distance calculation point, correct the increment of the sliding distance by multiplying the calculated increment of the sliding distance by at least one correction coefficient, calculate a sliding direction of the dresser at the sliding-distance calculation point, select one of preset plural sliding directions based on the calculated sliding direction, produce a sliding vector by adding the corrected increment of the sliding distance to a current sliding distance associated with the selected direction at the sliding-distance calculation point to update the sliding distance, and produce the sliding vector distribution of the dresser from the sliding vector and a position of the sliding-distance calculation point.

In a preferred aspect of the present invention, the dressing monitoring device is configured to calculate an index which indicates a variation in the sliding vector in a substrate contact area of the polishing member.

In a preferred aspect of the present invention, the dressing monitoring device is configured to determine dressing conditions that allow the index, indicating the variation in the sliding vector, to be less than or equal to a predetermined target value.

In a preferred aspect of the present invention, the dressing monitoring device is configured to calculate an index which indicates an orthogonality of sliding vectors in the substrate contact area of the polishing member.

In a preferred aspect of the present invention, the dressing monitoring device is configured to determine the dressing conditions that allow the index, indicating the orthogonality of the sliding vectors, to be larger than or equal to a predetermined target value.

When the polishing member (e.g., polishing pad) has a surface unevenness, the raised portion is preferentially scraped away by the dresser, while the recess portion is not likely to be scraped. According to the first aspect and the second aspect of the present invention, such an influence of the surface unevenness is reflected in the calculation of the sliding distance. The surface unevenness can be estimated from the sliding distance of the dresser. More specifically, a portion where the sliding distance of the dresser is long forms the recess portion, while a portion where the sliding distance of the dresser is short forms the raised portion. According to the present invention, the increment of the sliding distance is corrected with a smaller amount at the calculation point where the sliding distance of the dresser is long (i.e., the recess portion), and the increment of the sliding distance is corrected with a larger amount at the calculation point where the sliding distance of the dresser is short (i.e., the raised portion). Therefore, an accurate sliding-distance distribution reflecting the surface unevenness of the polishing member can be obtained. The profile of the polishing member can be estimated from the sliding-distance distribution.

According to the third aspect and the fourth aspect of the present invention, the sliding vector distribution of the dresser is obtained as the index for evaluating the dressing of the polishing member. This sliding vector represents not only the sliding distance of the dresser but also the sliding direction of the dresser. This sliding direction has an influence on a manner in which the dresser forms lines (scratches) on the polishing surface of the polishing member. Such lines (scratches) are considered to have an influence on a flow of a polishing liquid on the polishing member, a time during which the polishing liquid is present on the polishing member, and the like. Therefore, a dressing evaluation of the polishing member can be performed more accurately from the sliding vector distribution obtained.

DETAILED DESCRIPTION OF THE EMBODIMENTS

Figure 1:
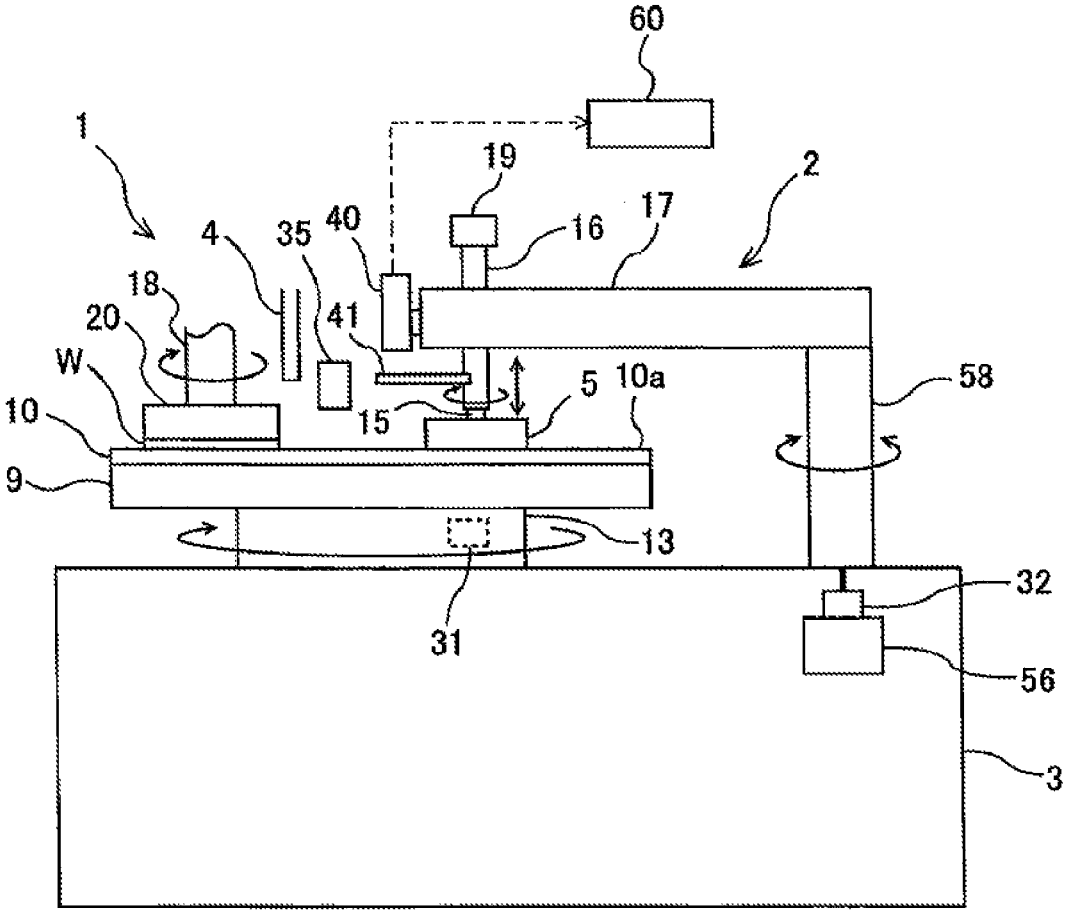
FIG. 1 is a schematic view showing a polishing apparatus for polishing a substrate, such as a wafer.

Embodiments according to the present invention will be explained with reference to the drawings. FIG. 1 is a schematic view showing a polishing apparatus for polishing a substrate, such as a wafer. As shown in FIG. 1, the polishing apparatus includes a polishing table 9 configured to hold a polishing pad (a polishing member) 10, a polishing unit 1 configured to polish a wafer W, a polishing liquid supply nozzle 4 configured to supply a polishing liquid onto the polishing pad 10, and a dressing unit 2 configured to dress (or condition) the polishing pad 10 which is used to polish the wafer W. The polishing unit 1 and the dressing unit 2 are provided on a base 3.

The polishing unit 1 includes a top ring (or a substrate holder) 20 coupled to a lower end of a top ring shaft 18. The top ring 20 is constructed so as to hold the wafer W on its lower surface by vacuum suction. The top ring shaft 18 is rotated by a motor (not shown in the drawing), and the top ring 20 and the wafer W are rotated together with this rotation of the top ring shaft 18. The top ring shaft 18 is moved vertically relative to the polishing pad 10 by a vertically moving mechanism (constructed, for example, by a servomotor and a ball screw) which is not shown in the drawing.

The polishing table 9 is coupled to a motor 13 which is arranged below the polishing table 9. The polishing table 9 is rotated about its axis by the motor 13. A polishing pad 10 is attached to an upper surface of the polishing table 9. An upper surface of the polishing pad 10 provides a polishing surface 10*a* for polishing the wafer W.

Polishing of the wafer W is performed as follows. The top ring 20 and the polishing table 9 are rotated respectively, and the polishing liquid is supplied onto the polishing pad 10. In this state, the top ring 20, holding the wafer W thereon, is lowered, and further the wafer W is pressed against the polishing surface 10*a* of the polishing pad 10 by a pressurizing mechanism (not shown in the drawing) which is constituted by airbags installed in the top ring 20. The wafer W and the polishing pad 10 are brought into sliding contact with each other in the presence of the polishing liquid, so that the surface of the wafer W is polished and planarized.

The dressing unit 2 includes a dresser 5 which is brought into contact with the polishing surface 10*a* of the polishing pad 10, a dresser shaft 16 coupled to the dresser 5, a pneumatic cylinder 19 provided at an upper end of the dresser shaft 16, and a dresser arm 17 for rotatably supporting the dresser shaft 16. Abrasive grains, such as diamond particles, are attached to a lower surface of the dresser 5. The lower surface of the dresser 5 constitutes a dressing surface for dressing the polishing pad 10.

The dresser shaft 16 and the dresser 5 are configured to be able to move vertically with respect to the dresser arm 17. The pneumatic cylinder 19 is a device which applies a dressing load on the polishing pad 10 to the dresser 5. The dressing load can be regulated by a pneumatic pressure supplied to the pneumatic cylinder 19.

The dresser arm 17 is constructed so as to pivot on a support shaft 58 by actuation of a motor 56. The dresser shaft 16 is rotated by a motor (not shown in the drawing) installed in the dresser arm 17. Thus, the dresser 5 is rotated about its axis by the rotation of the dresser shaft 16. The pneumatic cylinder 19 presses the dresser 5 against the polishing surface 10*a* of the polishing pad 10 through the dresser shaft 16 at a predetermined load.

Conditioning of the polishing surface 10*a* of the polishing pad 10 is performed as follows. The polishing table 9 and the polishing pad 10 are rotated by the motor 13, while a dressing liquid (e.g., pure water) is supplied from a dressing liquid supply nozzle (not shown in the drawing) onto the polishing surface 10*a* of the polishing pad 10. Further, the dresser 5 is rotated about its axis. The dresser 5 is pressed against the polishing surface 10*a* by the pneumatic cylinder 19 so that the lower surface (the dressing surface) of the dresser 5 is brought into sliding contact with the polishing surface 10*a*. In this state, the dresser arm 17 pivots to oscillate the dresser 5 on the polishing pad 10 in an approximately radial direction of the polishing pad 10. The polishing pad 10 is scraped away by the rotating dresser 5, so that the conditioning of the polishing surface 10*a* is performed.

A pad height sensor 40 for measuring a height of the polishing surface 10*a* is secured to the dresser arm 17. Furthermore, a sensor target 41, located opposite to the pad height sensor 40, is secured to the dresser shaft 16. The sensor target 41 vertically moves together with the dresser shaft 16 and the dresser 5, while the pad height sensor 40 is fixed in its position with respect to a vertical direction. The pad height sensor 40 is a displacement sensor, which is configured to measure a displacement of the sensor target 41 to thereby indirectly measure the height of the polishing surface 10*a* (i.e., a thickness of the polishing pad 10). Since the sensor target 41 is coupled to the dresser 5, the pad height sensor 40 can measure the height of the polishing surface 10*a* during conditioning of the polishing pad 10.

The pad height sensor 40 indirectly measures the polishing surface 10*a* from a position of the dresser 5 with respect to the vertical direction when the dresser 5 contacts the polishing surface 10*a*. Therefore, an average of heights of the polishing surface 10*a* that is in contact with the lower surface (the dressing surface) of the dresser 5 is measured by the pad height sensor 40. The pad height sensor 40 may comprise any type of sensors, such as a linear scale sensor, a laser sensor, an ultrasonic sensor, and an eddy current sensor.

The pad height sensor 40 is coupled to a dressing monitoring device 60, and an output signal of the pad height sensor 40 (i.e., a measured value of the height of the polishing surface 10*a*) is sent to the dressing monitoring device 60. The dressing monitoring device 60 has a function to obtain a profile (i.e., a cross-sectional shape of the polishing surface 10*a*) of the polishing pad 10 from measured values of the height of the polishing surface 10*a* and to determine whether the conditioning of the polishing pad 10 is performed correctly.

The polishing apparatus includes a table rotary encoder 31 configured to measure a rotation angle of the polishing table 9 and the polishing pad 10, and a dresser rotary encoder 32 configured to measure a pivot angle of the dresser 5. The table rotary encoder 31 and the dresser rotary encoder 32 are absolute encoders which measure an absolute value of an angle. These rotary encoders 31 and 32 are coupled to the dressing monitoring device 60, so that the dressing monitoring device 60 can obtain both the rotation angle of the polishing table 9 and the polishing pad 10 and the pivot angle of the dresser 5 when the pad height sensor 40 is measuring the height of the polishing surface 10*a*.

Figure 2:
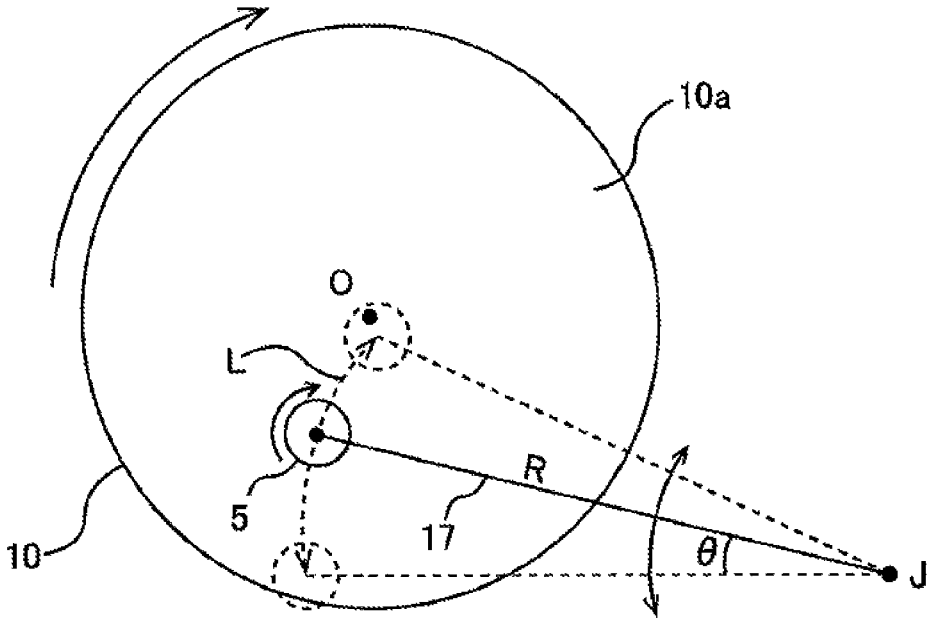
FIG. 2 is a plan view schematically showing a dresser and a polishing pad.

The dresser 5 is coupled to the dresser shaft 16 via a universal joint 15. The dresser shaft 16 is coupled to a motor (not shown in the drawing). The dresser shaft 16 is rotatably supported by the dresser arm 17, which causes the dresser 5 to oscillate in the radial direction of the polishing pad 10 as shown in FIG. 2 while contacting the polishing pad 10. The universal joint 15 is configured to transmit the rotation of the dresser shaft 16 to the dresser 5 while allowing the dresser 5 to tilt. The dresser 5, the universal joint 15, the dresser shaft 16, the dresser arm 17, and the rotating device (not shown in the drawing) constitute the dressing unit 2. The dressing monitoring device 60 for determining a sliding distance of the dresser 5 by simulation is electrically connected to the dressing unit 2. A dedicated or general-purpose computer can be used as the dressing monitoring device 60.

Figure 3A:
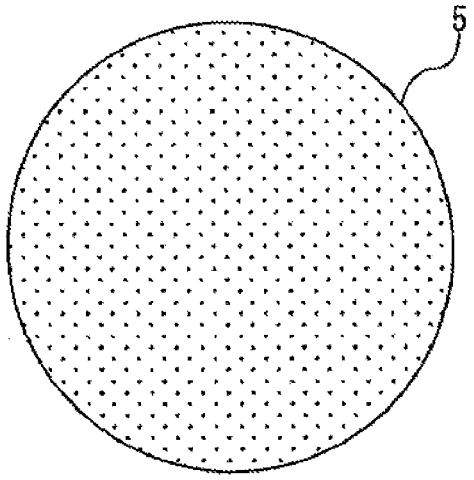
FIG. 3A, FIG. 3B, and FIG. 3C are views each showing an example of dressing surface.
Figure 3B:
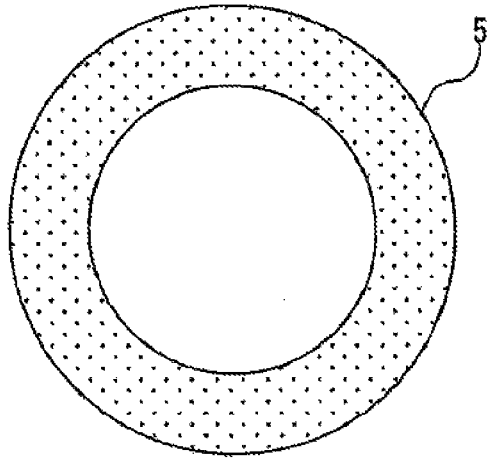
Figure 3C:
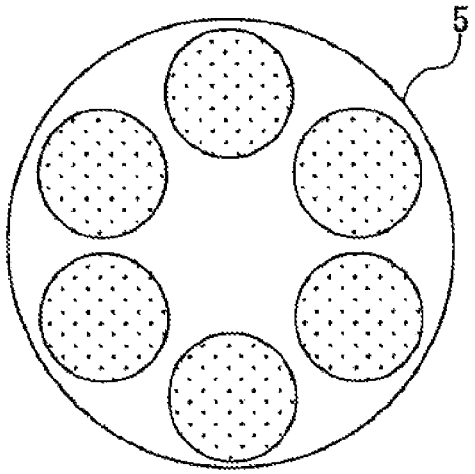

Abrasive grains, such as diamond particles, are fixed to the lower surface of the dresser 5. This portion, to which the abrasive grains are fixed, constitutes the dressing surface that is used to dress the polishing surface of the polishing pad 10. FIG. 3A through FIG. 3C are views each showing an example of the dressing surface. In the example shown in FIG. 3A, the abrasive grains are secured to the lower surface of the dresser 5 in its entirety to provide a circular dressing surface. In the example shown in FIG. 3B, the abrasive grains are secured to a periphery of the lower surface of the dresser 5 to provide an annular dressing surface. In the example shown in FIG. 3C, the abrasive grains are secured to surfaces of plural small-diameter pellets arranged around a center of the dresser 5 at substantially equal intervals to provide plural circular dressing surfaces.

As shown in FIG. 1, when dressing the polishing pad 10, the polishing pad 10 is rotated at a predetermined rotational speed in a direction as indicated by an arrow, and the dresser 5 is also rotated by the rotating device (not shown in the drawing) at a predetermined rotational speed in a direction as indicated by an arrow. In this state, the dressing surface (i.e., the surface with the abrasive grains provided thereon) of the dresser 5 is pressed against the polishing pad 10 at a predetermined dressing load to thereby dress the polishing pad 10. Further, the dresser arm 17 moves the dresser 5 to oscillate on the polishing pad 10 to thereby enable the dresser 5 to dress an area of the polishing pad 10 for use in a polishing process (i.e., a polishing area where the workpiece, such as a wafer, is polished).

Since the dresser 5 is coupled to the dresser shaft 16 via the universal joint 15, even if the dresser shaft 16 are inclined slightly with respect to the surface of the polishing pad 10, the dressing surface of the dresser 5 is kept in contact with the polishing pad 10 appropriately. A pad roughness measuring device 35 for measuring a surface roughness of the polishing pad 10 is provided above the polishing pad 10. A known, non-contact type (such as an optical type) surface roughness measuring device may be used as the pod roughness measuring device 35. This pad roughness measuring device 35 is coupled to the dressing monitoring device 60, so that a measured value of the surface roughness of the polishing pad 10 is sent to the dressing monitoring device 60.

Next, the oscillation of the dresser 5 will be explained with reference to FIG. 2. The dresser arm 17 pivots around a point J in a clockwise direction and a counterclockwise direction through a predetermined angle. A position of the point J corresponds to a center of the support shaft 58 shown in FIG. 1. This pivoting movement of the dresser arm 17 causes a rotating center of the dresser 5 to oscillate in the radial direction of the polishing pad 10 within a range indicated by an arc L.

Figure 4:
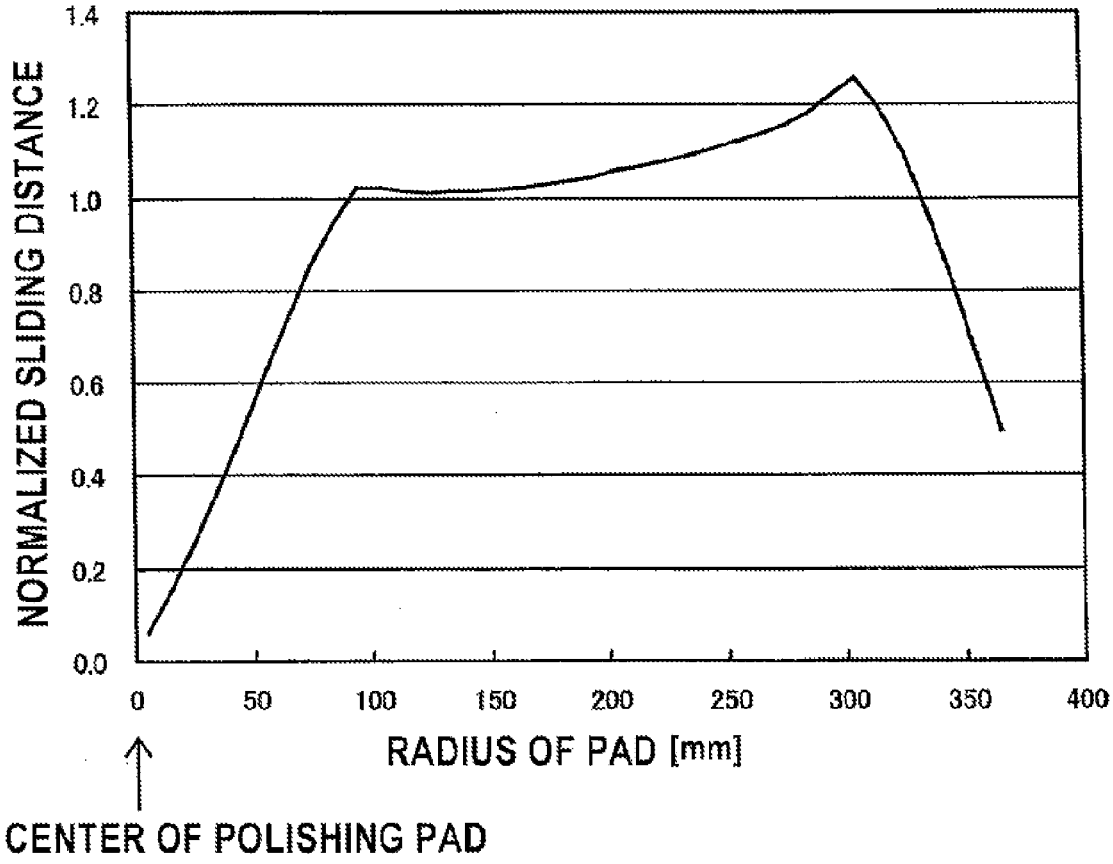
FIG. 4 is a view showing an example of a sliding-distance distribution of the dresser on the polishing pad.

The dresser 5 may be a type of dresser having the abrasive grains provided on the lower surface thereof in its entirety (i.e., the example shown in FIG. 3A). In this case, when an oscillating speed of the dresser 5 is constant over the whole range of the arc L, a distribution of the sliding distance of the dresser 5 on the polishing pad 10 is as shown in a graph of FIG. 4. The sliding-distance distribution shown in FIG. 4 is the distribution of the sliding distance of the dresser 5 in a radial direction of the polishing pad 10. A term "normalized sliding distance" in FIG. 4 is a value given by dividing the sliding distance by an average of sliding distances. A distribution of an amount of material of the polishing pad 10 that has been scraped away and the distribution of the sliding distance of the dresser 5 are considered to be in an approximately proportional relationship. Therefore, a profile of the polishing pad 10 can be estimated from the sliding-distance distribution.

Generally, if the distribution of the amount of material of the polishing pad 10 scraped away by the dresser 5 is substantially uniform in a contact area where the polishing pad 10 contacts the wafer, the polishing surface 10*a* of the polishing pad 10 becomes flat. As a result, a variation in polishing speed (i.e., removal rate) within the surface of the wafer to be polished is reduced. Because the distribution of the amount of the scraped material of the polishing pad 10 and the distribution of the sliding distance of the dresser 5 are considered to be in an approximately proportional relationship, in the case of the sliding-distance distribution as shown in FIG. 4, the variation in the removal rate within the surface of the wafer to be polished would increase, thus leading to an undesired consequence.

To avoid such a drawback, the oscillating speed of the dresser 5 may be changed according to locations on the arc L. For example, the arc L is divided into several oscillation segments, and an oscillating speed of the dresser 5 is determined for each of the oscillation segments as shown in table 1.

TABLE 1

| OSCILLATION SEGMENT | OSCILLATING SPEED |
|---|---|
| OSCILLATION SEGMENT 1 | OSCILLATING SPEED 1 |
| OSCILLATION SEGMENT 2 | OSCILLATING SPEED 2 |
| OSCILLATION SEGMENT 3 | OSCILLATING SPEED 3 |
| OSCILLATION SEGMENT 4 | OSCILLATING SPEED 4 |
| OSCILLATION SEGMENT 5 | OSCILLATING SPEED 5 |
| OSCILLATION SEGMENT 6 | OSCILLATING SPEED 6 |
| OSCILLATION SEGMENT 7 | OSCILLATING SPEED 7 |
| OSCILLATION SEGMENT 8 | OSCILLATING SPEED 8 |

In this specification, a combination of the rotational speed of the polishing pad 10 when dressing, the rotational speed of the dresser 5 when dressing, the dressing load, the oscillation segments of the dresser 5, and the oscillating speeds of the dresser 5 is referred to as dressing conditions (or a dressing recipe). It is noted that a dressing time, an oscillation range (i.e., a length of the are L), and a pivot radius R (i.e., a distance from the pivoting center point J of the dresser arm 17 to the center of the dresser 5) may be included in the dressing conditions. The above-described "oscillation segments" mean plural segments defined by dividing the "oscillation range (i.e., the length of the arc L)" along the radial direction of the polishing pad 10. As discussed above, determination of the dressing conditions from experiments requires a lot of time and labors. The method according to the embodiment utilizes the fact that there is a close relationship between the sliding distance of the dresser 5 at each point on the polishing surface of the polishing pad 10 and the amount of the material of the polishing pad 10 scraped away by the dresser 5, and calculates the sliding-distance distribution of the dresser 5 and can determine the dressing conditions.

The sliding distance of the dresser 5 will be described herein. The sliding distance of the dresser 5 is a travel distance of the dressing surface of the dresser 5 that slides over a certain point on the surface (polishing surface 10*a*) of the polishing pad 10. For example, in a case where both the polishing pad 10 and the dresser 5 are not rotated and the dresser 5 moves linearly on the polishing pad 10, when the dresser 5 with the abrasive grains arranged on the lower surface thereof in its entirety as shown in FIG. 3A moves such that the center of the dresser 5 travels across a certain point on the polishing pad 10, the sliding distance of the dresser 5 at that point is equal to the diameter of the dresser 5. When the dresser 5 with the abrasive grains arranged in a ring shape as shown in FIG. 3B moves such that the center of the dresser 5 travels across a certain point on the polishing pad 10, the sliding distance of the dresser 5 at that point is twice the width of the ring. This means that the sliding distance of the dresser 5 at a certain point on the polishing pad 10 is expressed as the product of the moving speed of the dresser 5 at that point and a transit time (i.e., a contact time) of a region where the abrasive grains are attached (i.e., the dressing surface).

As described above, there is a close relationship between the amount of the scraped (i.e., removed) material of the polishing pad 10 and the sliding distance. However, in some cases, there may be a large difference between the distribution of the amount of the scraped material of the polishing pad 10 and the distribution of the sliding distance. Thus, the sliding-distance distribution is corrected in accordance with thrusting of the abrasive grains (e.g., diamond particles) of the dresser 5 into the polishing pad 10. An example of a method of obtaining the sliding-distance distribution will be described with reference to a flowchart shown in FIG. 5. In this method, an increment of the sliding distance from a certain point of time until a small period of time elapses is calculated as the product of the small period of time and a relative speed of the dresser 5 at each point on the polishing pad 10 at that point of time, and the sliding distance is determined by integrating (or adding up) the increment of the sliding distance from a dressing start time to a dressing end time.

The dressing monitoring device 60 (see FIG. 1) is configured to read data, such as apparatus parameters and the dressing conditions, which are necessary for a pad dressing simulation. These data may be described directly in a program, or may be inputted from an input device, such as a keyboard. Alternatively, the data may be sent from a control computer of the polishing apparatus to the dressing monitoring device 60. In FIG. 1, the dressing monitoring device 60 is electrically connected to the dressing unit 2. However, the present invention is not limited to this embodiment. For example, the dressing monitoring device 60 may be installed independently with no direct communication with the dressing unit 2 via electrical signals.

The apparatus parameters include data on the range of the abrasive grains arranged on the dresser 5, data on a position of a dresser pivot axis (i.e., the point J), the pivot radius R of the dresser 5 (i.e., the distance from the point J to the dresser 5), the diameter of the polishing pad 10, and accelerations of the oscillating movement of the dresser 5.

The data on the range of the abrasive grains arranged on the dresser 5 are data including a shape and a size of the dressing surface. For example, in the case of using the dresser 5 with the abrasive grains arranged on the lower surface of the dresser 5 in its entirety as shown in FIG. 3A, the data include an outer diameter of the dresser 5. In the case of using the dresser 5 with the abrasive grains arranged in a ring shape as shown in FIG. 3B, the data include an outer diameter and an inner diameter of the ring. In the case of using dresser 5 with the abrasive grains arranged on plural small-diameter pellets as shown in FIG. 3C, the data include positions of centers of the respective pellets and diameters of the respective pellets.

The dressing conditions include the rotational speed of the polishing pad 10, a starting position of the oscillating movement of the dresser 5, the range of the oscillating movement of the dresser 5, the number of oscillation segments, widths of the respective oscillation segments, the oscillating speeds of the dresser 5 at the respective oscillation segments, the rotational speed of the dresser 5, the dressing load, and the dressing time.

The dressing monitoring device 60 also reads the number of dressing operations to be repeated (i.e., the set repetition number), together with the apparatus parameters and the dressing conditions. This is because, if the sliding-distance distribution is determined by the simulation of one dressing operation that is performed in a certain preset period of time, the sliding-distance distribution obtained may differ greatly from the distribution of the amount of the scraped material of the polishing pad 10. For example, in a case where the number of reciprocations of the dresser 5 per one dressing operation is small, the difference between the distribution of the amount of the scraped material of the polishing pad 10 and the distribution of the sliding distance of the dresser may be large.

Figure 6:
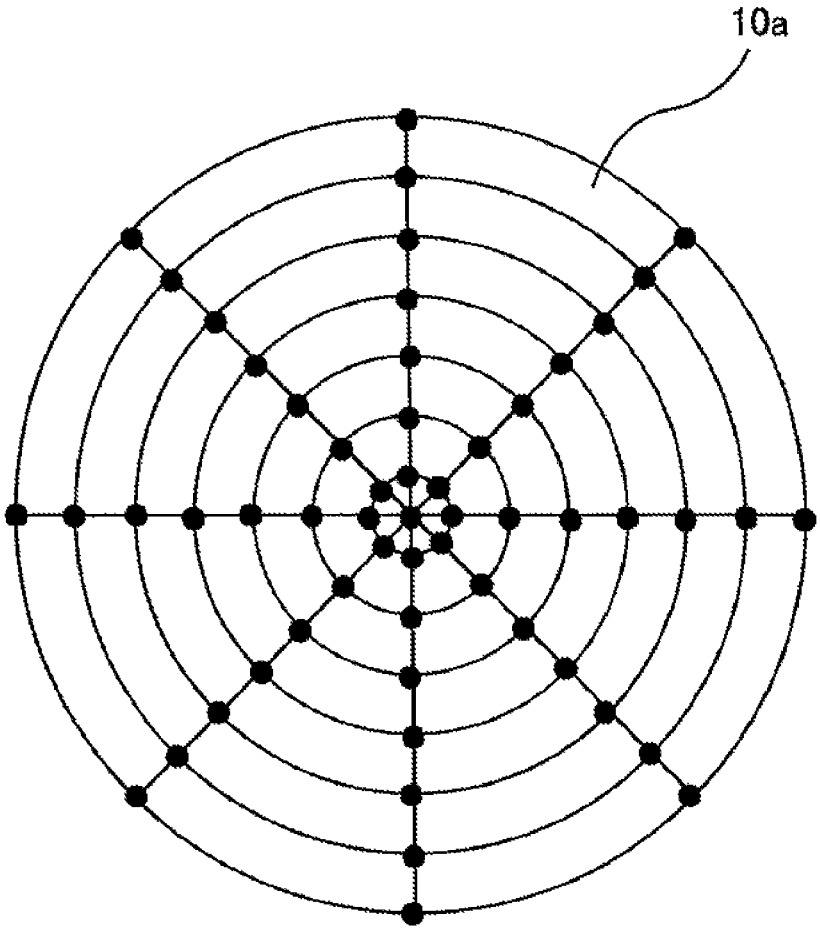
FIG. 6 is a view showing a plurality of sliding-distance calculation points which are defined on the polishing pad.

Next, coordinates of sliding-distance calculation points are set on the surface (i.e., the polishing surface) of the polishing pad 10. For example, a polar coordinate system with its origin located on the rotating center of the polishing pad 10 is defined on the polishing surface 10*a* of the polishing pad 10, and intersections of a grid that divides the polishing surface 10*a* in the radial direction and the circumferential direction are set to the sliding-distance calculation points. FIG. 6 shows an example of the sliding-distance calculation points. In FIG. 6, intersections of concentric circles and radially-extending lines are defined as the sliding-distance calculation points. In order to improve a computing speed, the number of zones to be divided may be reduced. It is not indispensable to divide the polishing surface in the circumferential direction. It is noted that an orthogonal coordinate system may be defined instead of the polar coordinate system.

Next, initial values of variables, such as a time and the sliding distance at each sliding-distance calculation point, are set. These variables vary with the calculation of the sliding distance.

Next, a time increment (i.e., the small period of time) ΔT is determined using intervals between the sliding-distance calculation points, the rotational speed of the polishing pad 10, the rotational speed of the dresser 5, the oscillating speed of the dresser 5, and other factor(s).

Next, the dressing monitoring device 60 judges the contact between the sliding-distance calculation point and the dresser 5 based on coordinates of the sliding-distance calculation point and positional information on the dressing surface of the dresser 5 at a certain time.

Next, the dressing monitoring device 60 calculates a relative speed Vrel between the dresser 5 and the polishing pad 10 at the sliding-distance calculation point. More specifically, the dressing monitoring device 60 calculates the relative speed Vrel by determining a magnitude of a difference between a velocity vector of the dresser 5 and a velocity vector of the polishing pad 10 at each sliding-distance calculation point at a certain time. The velocity vector of the dresser 5 is the sum of a velocity vector due to the rotation of the dresser 5 and a velocity vector due to the oscillating movement of the dresser 5. The velocity vector of the polishing pad 10 is a velocity vector due to the rotation of the polishing pad 10.

Next, the dressing monitoring device 60 calculates a dresser-contact-area ratio S. The dresser-contact-area ratio is a value given by dividing an area of the dressing surface in its entirety (which is a constant value) by an area of a portion of the dressing surface contacting the polishing pad 10 (which is a variable value). In a case where the polishing pad 10 is dressed at a constant dressing load, when part of the dresser 5 protrudes from the periphery of the polishing pad 10, contact surface pressure (i.e., dressing pressure) between the dresser and the polishing pad 10 increases by that much. Since the amount of the scraped material of the polishing pad 10 is considered to be approximately proportional to the contact surface pressure, an increase in the contact surface pressure will result in an increase in the amount of the scraped material of the polishing pad 10. Therefore, in the calculation of the sliding distance, it is necessary to correct the increment of the sliding distance in proportion to the increase in the contact surface pressure. The dresser-contact-area ratio S is used in this correction. Specifically, a change in the contact surface pressure is replaced with the sliding distance, so that an improved accuracy of the proportional relationship between the amount of the scraped material of the polishing pad 10 and the sliding distance (i.e., an improved consistency of the proportional relationship between them) can be realized. In a case where the dressing load is not constant and the dressing operation is performed at a constant dressing pressure, it is not necessary to correct the increment of the sliding distance. Therefore, in this case, it is not necessary to calculate the dresser-contact-area ratio.

Next, the dressing monitoring device 60 calculates an increment $\Delta D_0$ of the sliding distance from a certain point of time until a small period of time elapses. The $\Delta D_0$ is the product of the relative speed Vrel and the time increment ΔT.

$$\Delta D_0 = \mathrm{Vrel} \times \Delta T \tag{1}$$

The time increment ΔT represents a contact time during which the dresser 5 contacts the polishing pad 10 at the sliding-distance calculation point. If a certain sliding-distance calculation point is judged to be out of contact with the dresser 5 by the judgment of the contact between the sliding-distance calculation point and the dresser 5, the increment of the sliding distance at that sliding-distance calculation point is zero.

Next, the dressing monitoring device 60 corrects the increment $\Delta D_0$ of the sliding distance with use of the dresser-contact-area ratio S as follows.

$$\Delta D_1 = \Delta D_0 \times S \tag{2}$$

When the dressing operation is performed at a constant dressing pressure, it is not necessary to correct the increment of the sliding distance. Therefore, in this case, $\Delta D_1$ is equal to $\Delta D_0$.

Figure 7:
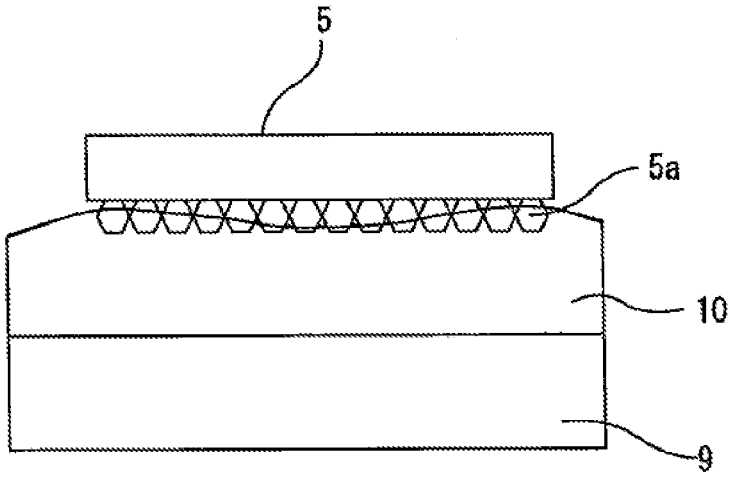
FIG. 7 is a view showing an example of a dressing operation when an undulation exists in a polishing surface of the polishing pad.

Next, the dressing monitoring device 60 further corrects the corrected increment $\Delta D_1$ of the sliding distance in accordance with an amount of the abrasive grains thrusting into the polishing pad 10. If the sliding distance varies from zone to zone in the polishing surface, a zone with a short sliding distance is scraped away in a small amount and therefore a thickness of the polishing pad 10 at that zone is relatively large. On the other hand, a zone with a long sliding distance is scraped away in a large amount and therefore the thickness of the polishing pad 10 at that zone is relatively small. As a result, undulation (i.e., unevenness) is formed in the polishing surface of the polishing pad 10. As shown in FIG. 7, if the undulation exists in the polishing surface of the polishing pad 10, the abrasive grains of the dresser 5 thrust into the polishing pad 10 deeply at the relatively thick zone of the polishing pad 10. On the other hand, at the relatively thin zone of the polishing pad 10, the abrasive grains of the dresser 5 do not thrust into the polishing pad 10 deeply. Therefore, the amount of the scraped material of the polishing pad 10 at the relatively thick zone of the polishing pad 10 is large, while the amount of the scraped material of the polishing pad 10 at the relatively thin zone of the polishing pad 10 is small. Thus, the dressing monitoring device 60 corrects the increment of the sliding distance so as to increase the increment of the sliding distance at a zone where the sliding distance is short and decrease the increment of the sliding distance at a zone where the sliding distance is long.

The above description can be simplified as follows. In the zone where the sliding distance is long, the polishing pad 10 becomes thin. As a result, the abrasive grains do not thrust into the polishing pad 10 deeply, and the amount of the scraped material of the polishing pad 10 is small. Therefore, the increment of the sliding distance is corrected so as to decrease at the zone where the sliding distance is long. On the other hand, in the zone where the sliding distance is short, the polishing pad 10 becomes thick. As a result, the abrasive grains thrust into the polishing pad 10 deeply, and the amount of the scraped material of the polishing pad 10 is large. Therefore, the increment of the sliding distance is corrected so as to increase at the zone where the sliding distance is short.

Figure 8:
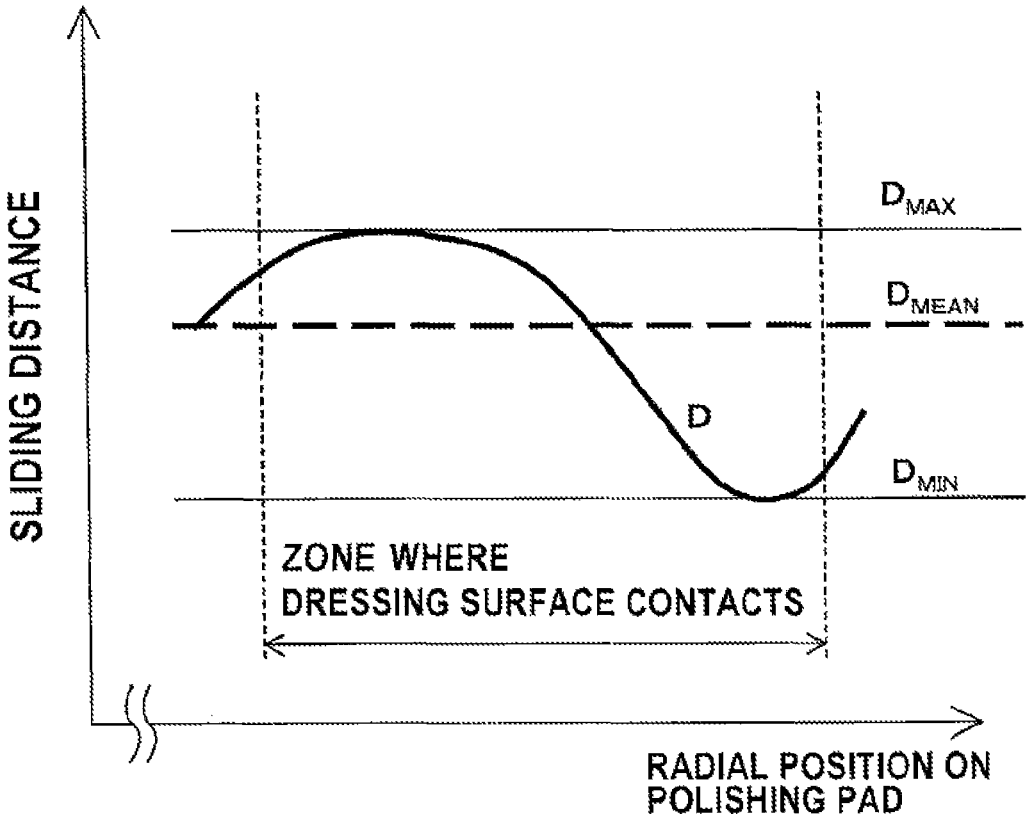
FIG. 8 is a view showing a two-dimensional sliding-distance distribution in a zone where a dressing surface contacts the polishing pad.

An example of the method of correcting the increment $\Delta D_1$ of the sliding distance in view of the thrusting of the abrasive grains into the polishing pad will be described with reference to FIG. 8. FIG. 8 is a graph showing the sliding-distance distribution in a zone where the dressing surface contacts the polishing pad at a certain point of time. The graph in FIG. 8 is expressed as a two-dimensional graph for easy comprehension. In FIG. 8, an area interposed between thin dotted lines is a zone where the dressing surface contacts the polishing pad, a thick solid line represents the sliding distance (D) of the dresser, and a thick dotted line represents an average ($D_{MEAN}$) of the sliding distance in the zone where the dressing surface contacts the polishing pad. $D_{MAX}$ and $D_{MIN}$ represent a maximum and a minimum of the sliding distance at the zone where the dressing surface contacts the polishing pad. The depth of the abrasive grains thrusting into the polishing pad 10 shows an opposite trend of the sliding distance (D) of the dresser 5. More specifically, when the former is large, the latter is small. On the other hand, when the former is small, the latter is large. Therefore, the depth of the abrasive grains thrusting into the polishing pad 10 can be expressed by using the sliding distance (D) of the dresser 5.

Where the sliding distances at plural sliding-distance calculation points contacting the dresser 5 at a certain point of time t are represented by $D_{v,t}$ (v=1, 2, 3, . . . , n) and an average of these sliding distances $D_{v,t}$ is represented by $D_{MEAN,t}$, a difference between the sliding distance $D_{v,t}$ at each sliding-distance calculation point and the average $D_{MEAN,t}$ is expressed as follows.

$$D_{v,t}-D_{MEAN,t}=\mathrm{Diff}_{v,t} \tag{3}$$

The correction of the increment $\Delta D_1$ of the sliding distance based on the unevenness (undulation) of the polishing surface 10*a* of the polishing pad 10 is performed by multiplying the increment $\Delta D_1$ of the sliding distance by an unevenness correction coefficient Uv. This unevenness correction coefficient Uv is expressed as follows.

$$Uv=\exp(-U_0\times\mathrm{Diff}_{v,t}) \tag{4}$$

In the above-described equation (4), the sign "exp" represents an exponential function. $U_0$ is a constant that is determined in advance through experiment, and is a value larger than 0 and smaller than ∞ ($0<U_0<\infty$). This constant $U_0$ indicates a degree of the correction. The larger the value of $U_0$ is, the larger an amount of the correction is. In a case where the constant $U_0$ is zero ($U_0=0$), the unevenness correction coefficient Uv is always 1. In this case, the correction for reflecting the unevenness of the polishing surface 10*a* is not performed.

The n number of unevenness correction coefficients Uv (namely, $Uv_1$, $Uv_2$, . . . , $Uv_n$) are obtained from the sliding distances $D_{v,t}$ ($D_{1,t}$, $D_{2,t}$, . . . , $D_{n,t}$) at the n number of sliding-distance calculation points, the average $D_{MEAN,t}$ of these sliding distances $D_{v,t}$, and the above-described equation (4). These plural unevenness correction coefficients correspond to the plural sliding-distance calculation points, respectively. Therefore, the increment $\Delta D_1$ of the sliding distance of the dresser 5 is corrected by multiplying the increment $\Delta D_1$ of the sliding distance at each sliding-distance calculation point by the corresponding unevenness correction coefficient Uv. The increment $\Delta D_1$ of the sliding distance at each sliding-distance calculation point is corrected with use of the unevenness correction coefficient Uv as follows.

$$\Delta D_2=\Delta D_1\times Uv \tag{5}$$

As can be seen from the equation (3) and the equation (4), the larger the value of the sliding distance is, the smaller the value of the unevenness correction coefficient Uv that is determined based on the sliding distance. According to the correction equation (5), the increment of the sliding distance at the sliding-distance calculation point on a raised portion is corrected with a larger amount, while the increment of the sliding distance at the sliding-distance calculation point on a recess portion is corrected with a smaller amount. As a result, the unevenness of the polishing surface 10*a* of the polishing pad 10 is reflected in the calculation of the increment of the sliding distance (i.e., the amount of the scraped material of the polishing pad 10). In this manner, in the present invention, the increment of the sliding distance is corrected in accordance with the depth of the abrasive grains thrusting into the polishing pad. In other words, the depth of the abrasive grains thrusting into the polishing pad is replaced with the sliding distance, so that an improved accuracy of the proportional relationship between the amount of the scraped material of the polishing pad 10 and the sliding distance (i.e., an improved consistency of the proportional relationship between them) can be realized.

Figure 9:
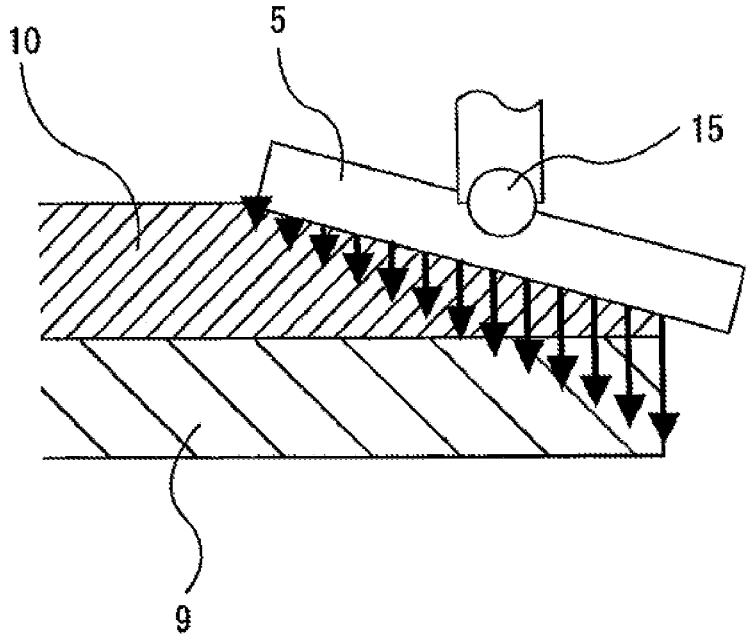
FIG. 9 is a view showing a state in which the dresser is inclined.

Next, the corrected increment $\Delta D_2$ of the sliding distance is further corrected in accordance with the tilting of the dresser 5 when the dresser 5 protrudes from the polishing pad 10. As described above, the dresser 5 is coupled to the dresser shaft 16 via the universal joint 15 that allows the dressing surface to tilt with respect to the polishing surface of the polishing pad 10. Therefore, when the dresser 5 protrudes from the polishing pad 10, as shown in FIG. 9, the dresser 5 tilts so that moments, which are generated by reaction forces from the polishing pad 10, are balanced on the universal joint 15 (in FIG. 9, the tilting of the dresser 5 is exaggerated for explanation). When the dresser 5 does not protrude from the polishing pad 10, the distribution of the contact pressure (dressing pressure) between the polishing pad 10 and the dresser 5 is approximately uniform. However, when the dresser 5 protrudes from the polishing pad 10, the distribution of the dressing pressure does not become uniform, and the dressing pressure approximately increases as the dresser 5 approaches the periphery of the polishing pad 10.

Figure 10A:
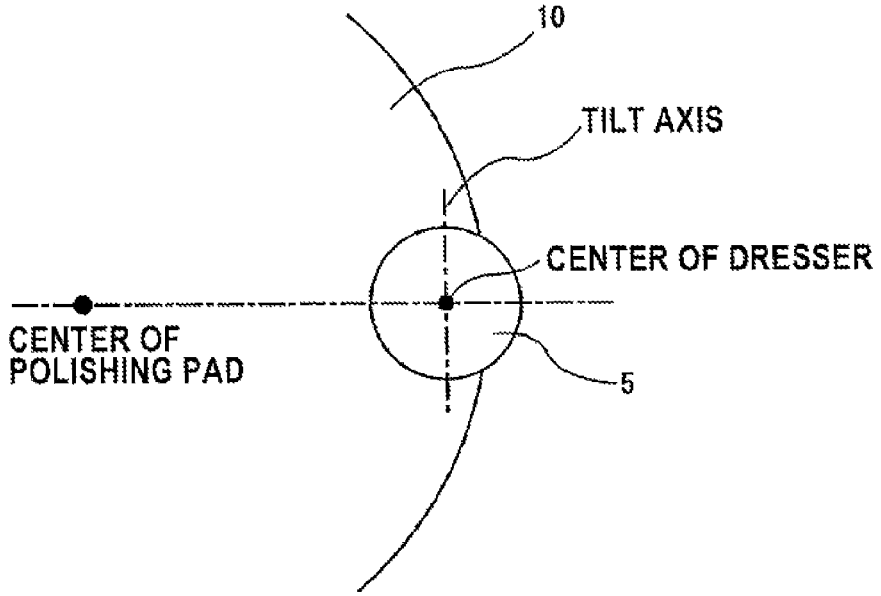
FIG. 10A is a plan view showing the dresser having a diameter of 100 mm when dressing the polishing pad having a diameter of 740 mm, with the periphery of the dresser protruding from the polishing pad by a maximum of 25 mm.
Figure 10B:
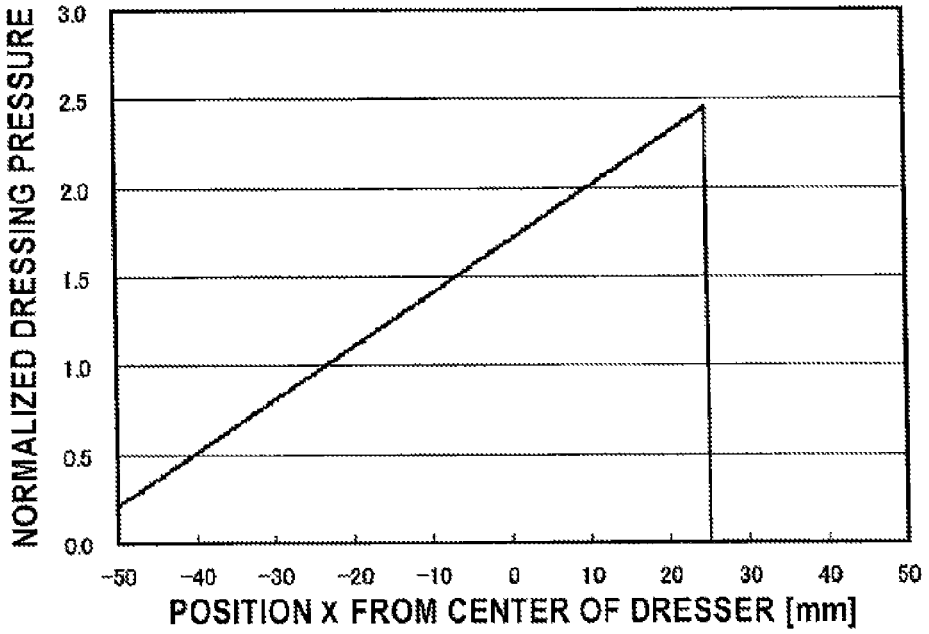
FIG. 10B is a graph showing a dressing-pressure distribution on a straight line passing through the center of the polishing pad and the center of the dresser.

FIG. 10A is a plan view showing the dresser 5 having a diameter of 100 mm when dressing the polishing pad 10 having a diameter of 740 mm, with the periphery of the dresser protruding from the polishing pad 10 by a maximum of 25 mm. FIG. 10B is a graph showing the distribution of the dressing pressure on a straight line passing through the center of the polishing pad 10 and the center of the dresser 5. In the example shown in FIG. 1 OA, the above-described dresser 5 with the abrasive grains secured to the lower surface thereof in its entirety is used (see FIG. 3A). FIG. 10B shows the distribution of the dressing pressure determined by the balance between the dressing load and the reaction force from the polishing pad 10 and the balance of the moments about the universal joint 15 which are generated by the reaction force from the polishing pad 10. The dressing load is a force applied to the dresser 5 via the dresser shaft 16 to press the dresser 5 against the polishing pad 10. In FIG. 10B, a vertical axis represents a normalized dressing pressure given by a normalization process in which a dressing pressure when the dresser does not protrude from the polishing pad 10 is defined as 1. More specifically, the normalized dressing pressure is a value given by dividing pressure at a position away from the center of the dresser 5 by a distance of x mm by pressure applied to the polishing pad 10 with the entire dressing surface contacting the polishing pad 10. A horizontal axis represents a position from the center of the dresser 5. The position of the center of the dresser is expressed as zero, and positions closer to the center of the polishing pad are expressed by negative values.

Figure 11A:
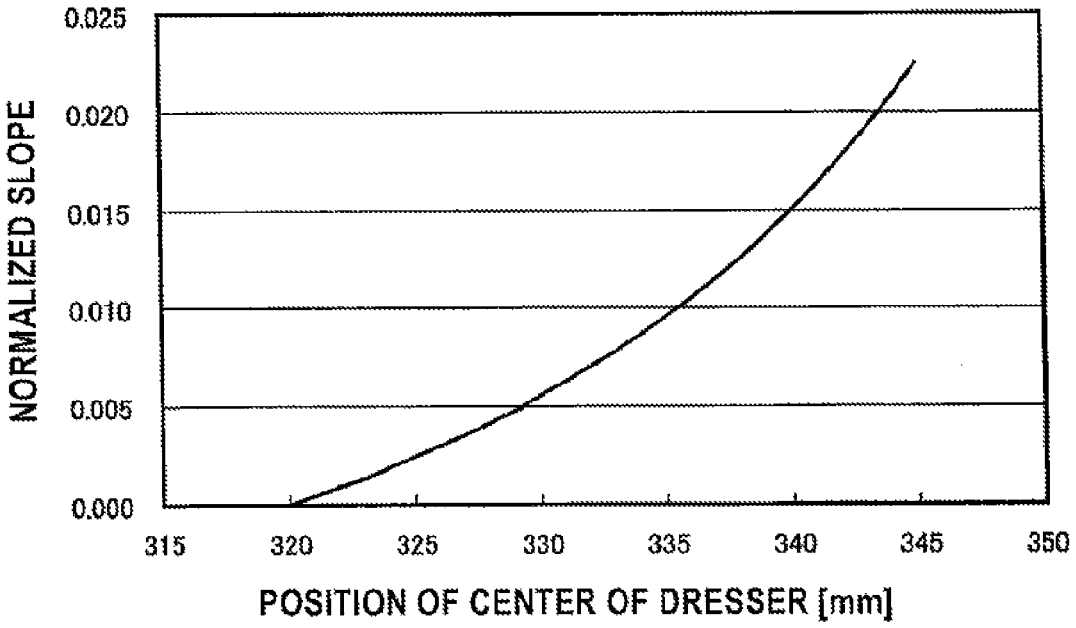
FIG. 11A is a graph showing a slope (i.e., a normalized slope) of the dressing-pressure distribution when the dresser is protruding from the polishing pad.
Figure 11B:
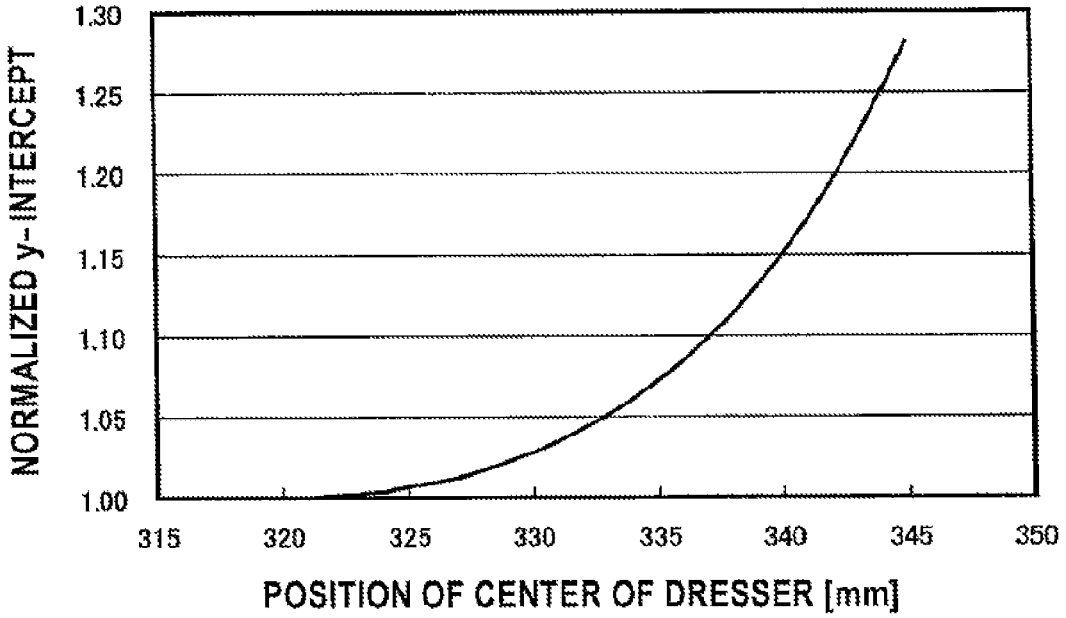
FIG. 11B is a graph showing a normalized y-intercept.

As can be seen from FIG. 10A and FIG. 10B, when the dresser 5 is protruding from the polishing pad 10, the dressing pressure can be expressed roughly by a linear function using the position from the center of the dresser (i.e., a distance from a tilt axis shown in FIG. 10A and a negative value at the polishing-pad-center side: x). Further, as shown in FIG. 11A, a slope (i.e., a normalized slope: $f_\Delta$) of this linear function is determined uniquely with respect to a distance between the center of the polishing pad and the center of the dresser (a dresser central position: $C_0$). The normalized slope is given by putting two imaginary points on a straight line of the linear function shown in FIG. 10B and dividing a difference in the normalized dressing pressure between the two points by a difference in the position from the center of the dresser between the two points. Further, a value of the dressing pressure at the center of the dresser is determined uniquely with respect to the distance between the center of the polishing pad and the center of the dresser (the dresser central position: $C_0$). FIG. 11B shows an example of it. FIG. 11B does not show a value of the normalized dressing pressure itself at the center of the dresser and shows normalized y-intercept ($f_{y0}$), which is given by dividing the normalized dressing pressure at the center of the dresser by the normalized dressing pressure at a position where the dressing pressure takes an average thereof. In the example shown in FIG. 10B, the normalized dressing pressure takes an average at a position where the distance from the center of the dresser is −12.5 mm. Therefore, the normalized dressing pressure at a certain point on the dressing surface at a certain dresser central position $C_0$ can be calculated from the normalized slope and the normalized y-intercept of the dressing pressure at the dresser central position $C_0$ and the distance of said certain point from the tilt axis of the dresser (the distance from the center of the dresser). Therefore, a correction coefficient K with respect to the tilting of the dresser 5 is defined as follows.

$$K=f_\Delta(C_0)\times x+f_{y0}(C_0) \tag{6}$$

The increment $\Delta D_2$ of the sliding distance is corrected as follows.

$$\Delta D_3=\Delta D_2\times K \tag{7}$$

In this manner, in the present invention, the increment of the sliding distance is further corrected in accordance with the tilting of the dresser 5. In other words, the tilting of the dresser 5 is replaced with the sliding distance, so that an improved accuracy of the proportional relationship between the amount of the scraped material of the polishing pad 10 and the sliding distance (i.e., an improved consistency of the proportional relationship between them) can be realized.

The polishing pad 10 is made of an elastic material. Therefore, it is presumed that when the polishing pad 10 is pressed by the dresser 5, the polishing pad 10 is hardened and as a result the surface roughness of the polishing pad decreases. Furthermore, it is presumed that dressing debris is deposited on the surface of the polishing pad 10 and as a result the surface roughness of the polishing pad decreases. Such a decrease in the surface roughness of the polishing pad 10 is expressed as a decrease in a coefficient of friction of the polishing pad 10. As the coefficient of friction of the polishing pad 10 decreases, the dresser 5 more easily slides on the polishing surface 10*a* of the polishing pad 10, and the amount of the scraped material of the polishing pad 10 is reduced.

Thus, next, the corrected increment $\Delta D_3$ of the sliding distance is further corrected in accordance with the decrease in the coefficient of friction (i.e., the surface roughness) of the polishing pad 10. As model parameters, two positive integers P1 and P2 are set in advance. A relationship between P1 and P2 is P1>P2. Further, a friction correction coefficient c is set in advance. This friction correction coefficient c is a value larger than 0 and smaller than 1, i.e., $0<c<1$. The calculation of the sliding distance is performed every time the time increment $\Delta T$ elapses. More specifically, the increment of the sliding distance in the time increment $\Delta T$ is added to an accumulated sliding distance at a certain time t. Simultaneously, the time is updated by adding the time increment $\Delta T$ to the current time t. In the calculations of the sliding distance performed P1 times in the past, if the dresser 5 contacts a certain sliding-distance calculation point P2 times or more, the increment $\Delta D_3$ of the sliding distance is corrected by multiplying the increment $\Delta D_3$ of the sliding distance at that sliding-distance calculation point by the friction correction coefficient c.

$$\Delta D_4=\Delta D_3\times c \tag{8}$$

According to the correction shown in the equation (8), the decrease in the coefficient of friction (i.e., the surface roughness) of the polishing pad 10 due to the contact with the dresser 5 is reflected in the calculation of the increment of the sliding distance. In other words, the change in the coefficient of friction is replaced with the sliding distance, so that an improved accuracy of the proportional relationship between the amount of the scraped material of the polishing pad 10 and the sliding distance (i.e., an improved consistency of the proportional relationship between them) can be realized.

Generally, the dressing of the polishing pad 10 is performed before and after the polishing of the wafer. In other words, the polishing of the wafer is performed before and after the dressing operation. The polishing of the wafer is performed by pressing the wafer against the polishing pad 10 while supplying a polishing liquid (e.g., slurry) onto the polishing pad 10. Therefore, the surface state of the polishing pad 10 changes to a certain degree due to the influence of the polishing of the wafer. Specifically, the cutting rate of the polishing pad 10 by the dresser 5 is considered to be changed due to the polishing of the wafer. A degree of the influence of the wafer polishing on dressing of the polishing pad 10 is expected to be approximately proportional to a sliding distance of the wafer on the polishing pad 10 during the polishing of the wafer. Thus, next, the increment $\Delta D_4$ of the sliding distance of the dresser 5 is further corrected in accordance with the sliding distance of the wafer.

Where the sliding distance per one wafer (substrate) at the sliding-distance calculation point on the polishing pad 10 is represented by a wafer sliding distance Dw and a sliding distance of the dresser 5 per one dressing operation at that sliding-distance calculation point is represented by a dresser sliding distance Dd, a ratio $RT_{wd}$ of the wafer sliding distance Dw to the dresser sliding distance Dd is expressed as $$RT_{wd}=Dw/Dd \quad (9)$$

The wafer sliding distance Dw is obtained by multiplying a speed of the wafer relative to the polishing pad 10 at the sliding-distance calculation point by a contact time during which the wafer contacts the polishing pad 10 at the sliding-distance calculation point.

A wafer (substrate) sliding-distance correction coefficient Ew based on the sliding distance of the wafer is given by $$Ew=\exp(E_0 \times RT_{wd}) \quad (10)$$

where $E_0$ is a constant that is determined in advance through experiment, and is a positive or negative value. In a case where the correction is not required, $E_0$ is zero.

The increment $\Delta D_4$ of the sliding distance is then corrected with use of the wafer sliding-distance correction coefficient Ew given by the above-described equation (10) as follows.

$$\Delta D_5=\Delta D_4 \times Ew \quad (11)$$

According to this correcting equation, the influence on the polishing pad 10 as a result of polishing of the wafer (substrate) is reflected in the calculation of the sliding distance. In other words, the influence on the polishing pad 10 as a result of polishing of the wafer is replaced with the sliding distance, so that an improved accuracy of the proportional relationship between the amount of the scraped material of the polishing pad 10 and the sliding distance (i.e., an improved consistency of the proportional relationship between them) can be realized.

The increment $\Delta D_5$ of the sliding distance is a result of performing corrections expressed by the above-described equations (2), (5), (7), (8), and (11) on the increment $\Delta D_0$ of the sliding distance in the small period of time. This increment $\Delta D_5$ of the sliding distance is added to a sliding distance at a current time to thereby update the sliding distance. At this step, because the amount of the scraped material of the polishing pad 10 is considered to be approximately proportional to the dressing load and the dressing pressure, the increment $\Delta D_5$ of the sliding distance may be further corrected in accordance with the preset dressing load and dressing pressure.

Next, the dressing monitoring device 60 prepares for calculation of an increment of the sliding distance in a subsequent time increment (the small period of time). Specifically, the dressing monitoring device 60 virtually rotates the polishing pad 10 to move the slide-distance calculation point and virtually oscillates the dresser 5 to move the dresser 5. Further, the dressing monitoring device 60 updates a time (i.e., adds the time increment to a time).

In the movement of the dresser 5, it is preferable to calculate a position of the dresser 5 at the next time increment in consideration of the acceleration of the dresser 5 at a turning point of the dresser 5 and a point between the oscillation segments (see table 1). The oscillating dresser 5 turns back at both ends (i.e., a pad-center-side end and a pad-periphery-side end) of its movement path on the polishing pad 10. Therefore, the oscillating speed increases and decreases (i.e., a positive acceleration or negative acceleration), and the sliding distance of the dresser 5 per unit time varies. Further, when the dresser 5 moves across each point between the oscillation segments (see table 1), the oscillating speed increases or decreases at the boundaries between the oscillation segments and at their neighboring areas as well. Therefore, the sliding distance of the dresser 5 per unit time varies. Thus, in order to accurately calculate the sliding distance itself at each point on the polishing pad 10, it is preferable for the simulation to reflect the acceleration of the movement of the dresser 5. By reflecting the acceleration of the dresser 5, a more accurate sliding distance can be calculated.

If the time has reached the dressing time, the dressing monitoring device 60 initializes the time, and repeats the calculation of the sliding distance for the dressing time until the preset repetition number (i.e., the number of dressing operations to be repeated) is reached. After the calculation of the sliding distance for the dressing time is repeated until the preset repetition number is reached, the dressing monitoring device 60 displays a result of the calculation, and performs ending processes, such as storing of the calculation result. Since the sliding distance is approximately proportional to the amount of the scraped material of the polishing pad 10, the calculated sliding distance may be multiplied by a conversion factor (a proportional constant) so as to obtain a calculation result of the amount of the scraped material of the polishing pad 10.

The finally obtained increment $\Delta D_5$ of the sliding distance is expressed from the equations (2), (5), (7), (8) and (11) as follows.

$$\Delta D_5=\Delta D_0 \times S \times Uv \times K \times c \times Ew \quad (12)$$

Figure 5:
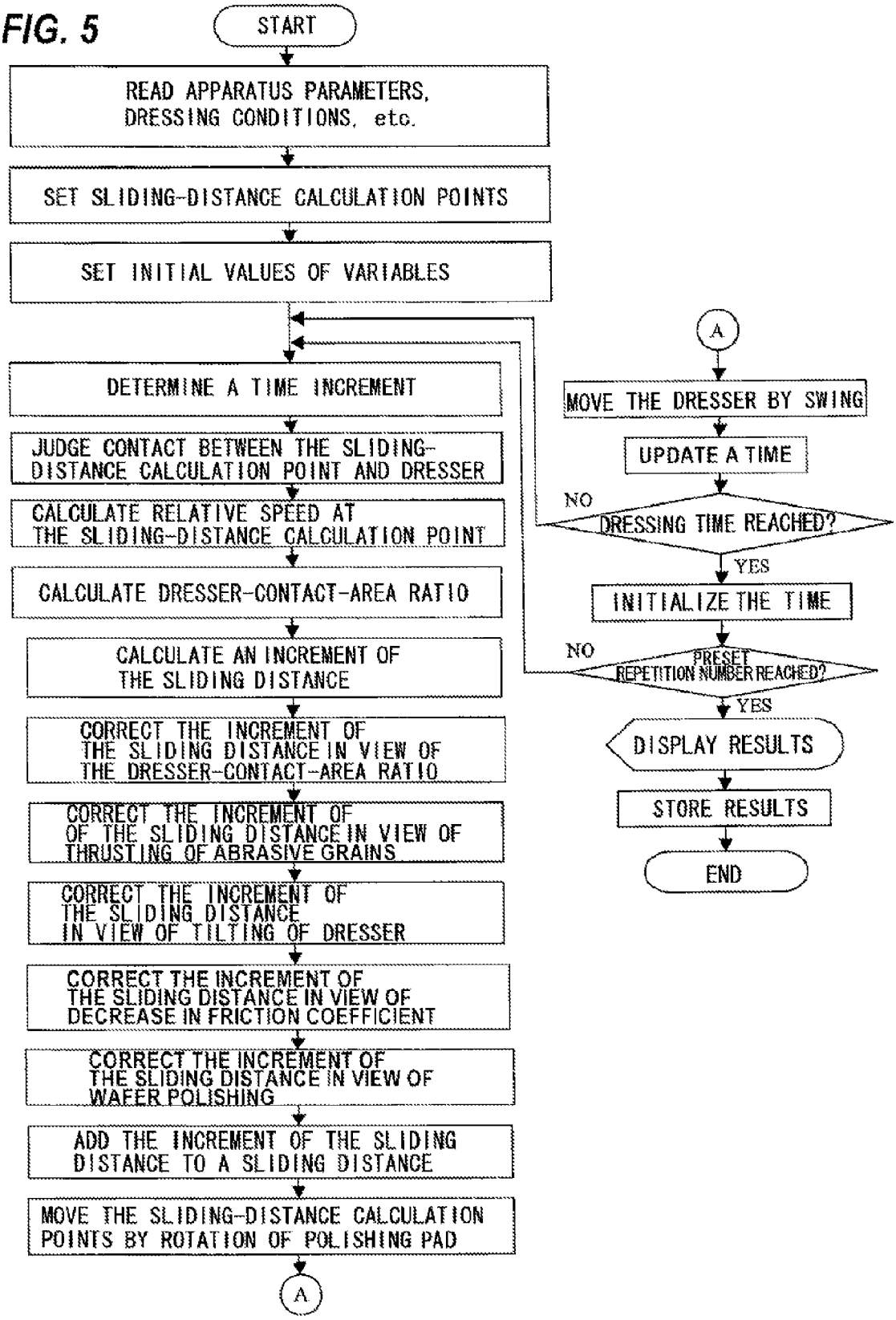
FIG. 5 is a flowchart showing a method of obtaining the sliding-distance distribution.

In the above description with reference to FIG. 5, the correction steps are performed in the order of the calculation of the simple increment $\Delta D_0$ of the sliding distance, the correction of the increment of the sliding distance for reflecting the dresser-contact-area ratio, the correction of the increment of the sliding distance for reflecting the thrusting of the abrasive grains into the polishing pad, the correction of the increment of the sliding distance for reflecting the tilting of the dresser, the correction of the increment of the sliding distance for reflecting the decrease in the coefficient of friction of the polishing pad 10, and the correction of the increment of the sliding distance for reflecting the sliding distance of the wafer (substrate). However, as can be seen from the above equation (12), the correction of the increment of the sliding distance does not depend on the order of the correction coefficients. The increment of the sliding distance may be corrected without using one or more of these correction coefficients. The corrected increment of the sliding distance is accumulated along a time axis, so that the sliding distance of the dresser 5 per one dressing operation is determined.

Figure 12:
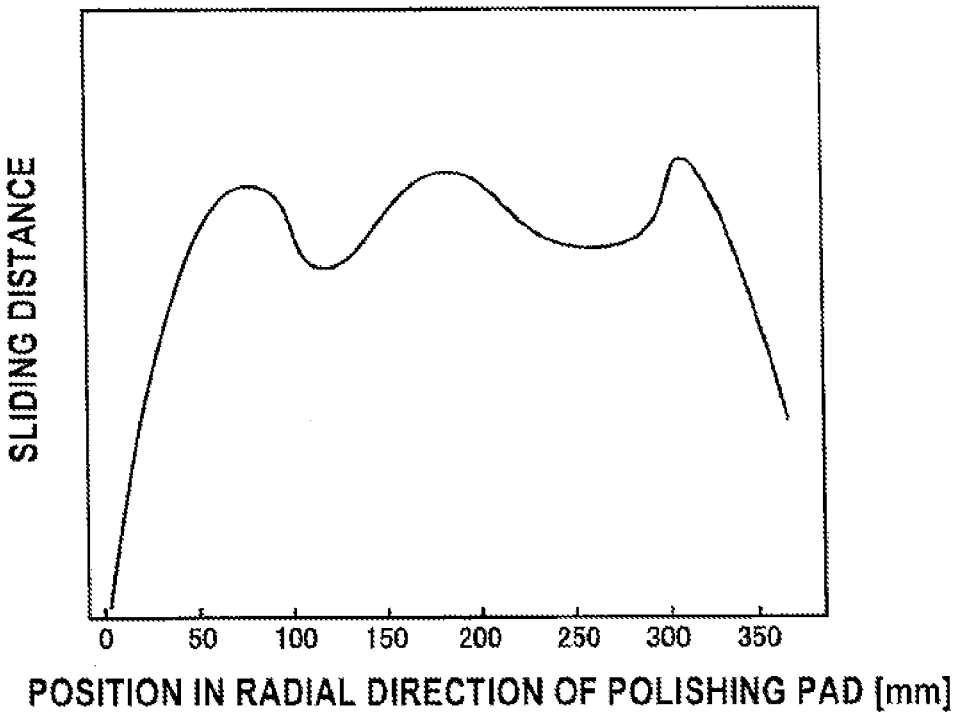
FIG. 12 is a view showing the sliding-distance distribution.

FIG. 12 is a view showing the sliding-distance distribution calculated according to the above-described process. More specifically, FIG. 12 shows the sliding distance at the plural sliding-distance calculation points arrayed along the radial direction of the polishing pad 10. The sliding distance of the dresser 5 is approximately proportional to the amount of the material of the polishing pad 10 scraped away by the dresser 5. Therefore, the sliding-distance distribution shown in FIG. 12 corresponds to a profile of the amount of the scraped material or a profile of the cutting rate of the polishing pad 10 that has been dressed by the dresser 5. If an initial thickness of the polishing pad 10 is known, an information corresponding to a pad thickness profile is immediately obtained from this sliding-distance distribution.

The sliding-distance distribution calculated according to the above-described process can be used to estimate the profile and the cutting rate, each of which is an index for evaluating the dressing of the polishing pad 10. The profile of the polishing pad 10 represents a cross-sectional shape of the polishing surface 10*a* of the polishing pad 10 along the radial direction. The cutting rate of the polishing pad 10 represents an amount (or a thickness) of the material of the polishing pad 10 scraped away by the dresser 5 per unit time. The profile and the cutting rate of the polishing pad 10 can be estimated from the sliding-distance distribution along the radial direction of the polishing pad 10 as shown in FIG. 12. However, these evaluation indexes may not express adequately a polishing performance of the polishing pad 10. For example, even if the profiles are the same and the cutting rates are the same, the polishing rate and the polishing profile may vary.

Thus, in addition to the conventional dressing evaluation indexes, the dressing monitoring device 60 obtains a sliding vector which is the sliding distance containing a sliding direction of the dresser 5 as information. Specifically, the sliding vector is constituted by accumulated sliding distances in each sliding direction. The sliding direction of the dresser 5 is a direction in which the dresser 5 sweeps across the sliding-distance calculation point on the polishing pad 10, and is a moving direction of the dresser 5 relative to the polishing pad 10. The sliding direction at a certain time when the dressing pad 10 is being dressed can be determined from the rotational speed of the polishing pad 10 (i.e., the rotational speed of the polishing table 9), the rotational speed of the dresser 5, the oscillating speed of the dresser 5, a relative position between the dresser 5 and the polishing pad 10, and other factor(s) by a calculation. The sliding direction is expressed as an angle from the radial direction of the polishing pad 10.

The dressing monitoring device 60 stores a plurality of preset sliding directions therein in advance. The dressing monitoring device 60 calculates the increment of the sliding distance of the dresser 5 at the sliding-distance calculation point, and further calculates the sliding direction of the dresser 5 at that sliding-distance calculation point. The calculated sliding direction is represented by one of the plurality of sliding directions. Each of the sliding directions that are set in advance in the dressing monitoring device 60 is a direction representing a predetermined angle range. The calculated sliding direction that falls within the predetermined angle range is represented by a sliding direction that has been preset for that predetermined angle range. For example, if a calculated sliding direction is within an angle range of 80° to 100°, this calculated sliding direction is represented by a sliding direction of 90° that has been set in advance for the angle range from 80° to 100°. The dressing monitoring device 60 allocates the calculated sliding direction to one of the preset sliding directions in accordance with the angle of the calculated sliding direction.

The sliding direction determined in this manner is associated with the increment of the sliding distance at the same sliding-distance calculation point. The dressing monitoring device 60 performs, during the dressing operation, the determining of the sliding direction at each sliding-distance calculation point, and the calculation (including the corrections) and the accumulation of the increment of the sliding distance with respect to each sliding direction, and stores the results therein. The sliding distance with respect to each sliding direction at each sliding-distance calculation point is obtained as the sliding vector, and is stored in the dressing monitoring device 60. The dressing monitoring device 60 has a function to display the sliding vector at each of the plural sliding-distance calculation points arrayed along the radial direction of the polishing pad 10.

Figure 13:
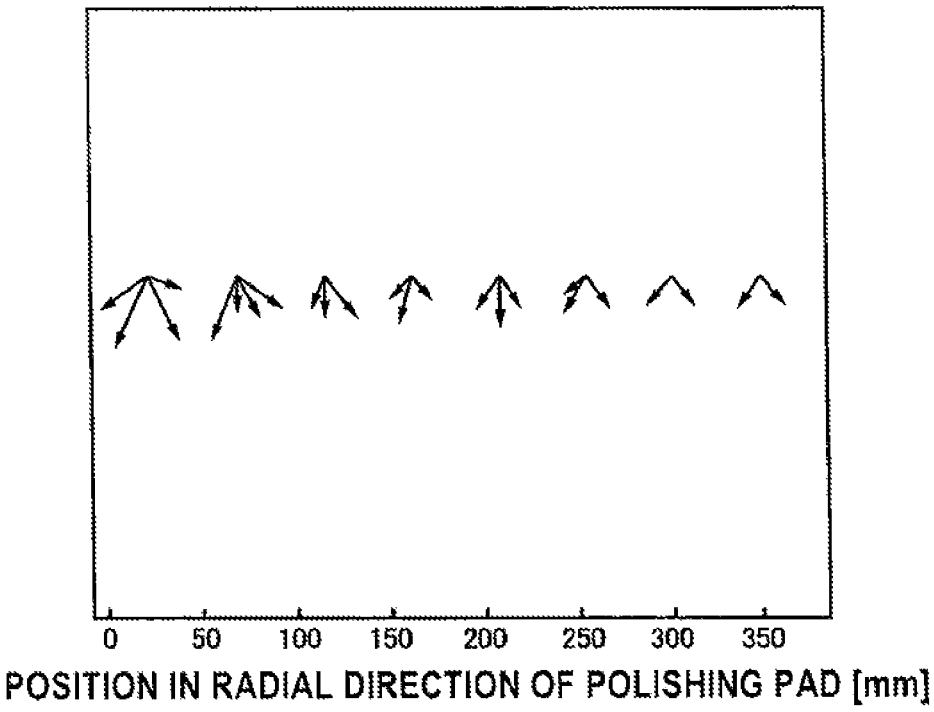
FIG. 13 is a view showing sliding vectors at the sliding-distance calculation points which are arrayed in a radial direction of the polishing pad.

FIG. 13 is a view showing the sliding vectors at the sliding-distance calculation points that are arrayed along the radial direction of the polishing pad 10. The sliding vectors are obtained every time the dressing operation is performed. FIG. 13 shows the sliding vectors at eight sliding-distance calculation points. Each sliding vector at each sliding-distance calculation point is an accumulative sliding vector, which is obtained during one dressing operation, with respect to each sliding direction. The dressing monitoring device 60 displays the sliding vectors arranged along the radial direction of the polishing pad 10. A length of the sliding vector indicates the sliding distance of the dresser 5 per one dressing operation, and a direction of the sliding vector indicates a sliding direction of the dresser 5. The dressing monitoring device 60 produces a sliding vector distribution of the dresser 5 as shown in FIG. 13 from the sliding vectors and the positions of the plural sliding-distance calculation points.

Figure 14:
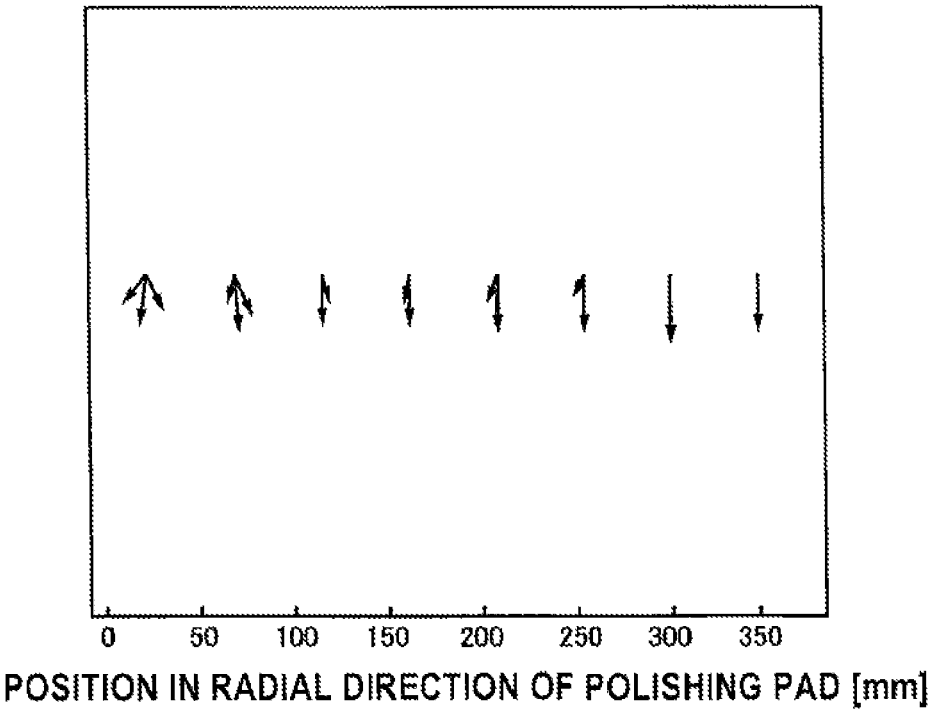
FIG. 14 is a view showing the sliding vectors when a polishing table is rotated at a higher speed and the dresser is rotated at a lower speed than those in the dressing conditions of FIG. 13.

The distribution of the sliding vectors on the polishing pad 10 can be seen in FIG. 13. A spread of the sliding vectors at each sliding-distance calculation point depends on the rotational speed of the polishing table 9, the rotational speed of the dresser 5, and the oscillating speed of the dresser 5. FIG. 14 is a view showing the sliding vectors when the polishing table 9 is rotated at a higher speed and the dresser 5 is rotated at a lower speed than those in the dressing conditions of FIG. 13. The sliding vectors in the example shown in FIG. 14 do not spread very much as compared to the sliding vectors shown in FIG. 13.

Figure 15:
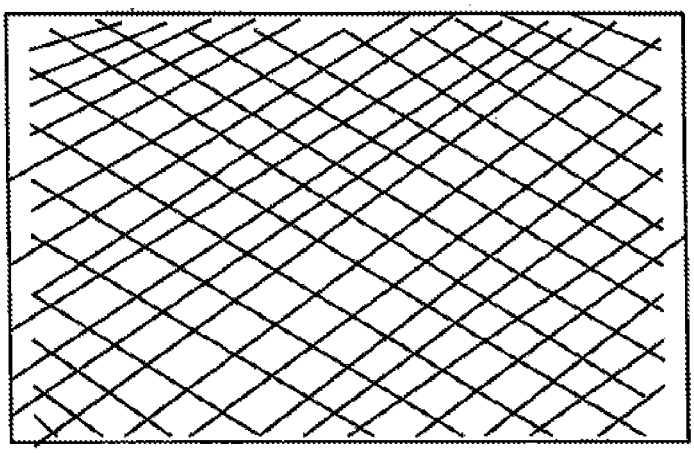
FIG. 15 is a schematic view showing a state of the polishing surface of the polishing pad under the dressing conditions for obtaining the sliding vectors shown in FIG. 13.
Figure 16:
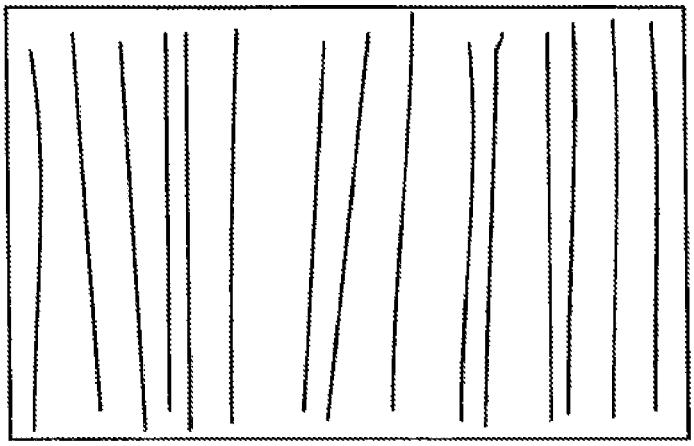
FIG. 16 is a schematic view showing a state of the polishing surface of the polishing pad under the dressing conditions for obtaining the sliding vectors shown in FIG. 14.

FIG. 15 is a schematic view showing a state of the polishing surface 10*a* of the polishing pad 10 under the dressing conditions for obtaining the sliding vectors shown in FIG. 13. FIG. 16 is a schematic view showing a state of the polishing surface 10*a* of the polishing pad 10 under the dressing conditions for obtaining the sliding vectors shown in FIG. 14. The sliding vectors shown in FIG. 13 indicate that the dresser 5 slides on the polishing pad 10 in various directions. As a result, as shown in FIG. 15, mesh-like lines (or scratches) are formed on the polishing surface 10*a* of the polishing pad 10. In contrast, the sliding vectors shown in FIG. 14 indicate that the dresser 5 slides on the polishing pad 10 in approximately the same direction. As a result, as shown in FIG. 16, approximately parallel lines (or scratches) are formed on the polishing surface 10*a* of the polishing pad 10.

The scratches formed on the polishing surface 10*a* of the polishing pad 10 have an effect on the surface roughness of the polishing pad 10 and a spreading manner of the polishing liquid (slurry) supplied to the polishing surface 10*a*. The mesh-like scratches shown in FIG. 15 is expected to more easily retain the polishing liquid on the polishing pad 10, and to increase the polishing rate of the wafer. Therefore, it is preferable that the dressing conditions be set so as to spread the sliding vectors over the polishing pad 10 in its entirety. Specific factors of the dressing conditions may include the rotational speed of the polishing table 9, the rotational speed of the dresser 5, and the oscillating speed of the dresser 5.

Next, indexing of the sliding distance distribution will be described. If an area where the dressing is not performed is present in a wafer contact area on the polishing surface 10*a* of the polishing pad 10, the polishing pad 10 cannot exhibit a continuous and stable polishing performance. Thus, the dressing monitoring device 60 calculates a surface dressing ratio which represents a ratio of a dressing area (an area where the dresser 5 contacts the polishing pad 10) to the wafer contact area on the polishing pad 10, after the termination of one dressing operation. The dressing monitoring device 60 evaluates whether or not the polishing pad 10 was successfully dressed based on the surface dressing ratio.

More specifically, when there are the m number of sliding-distance calculation points that have never contacted the dresser 5 during the dressing operation, out of the n number of sliding-distance calculation points in the wafer contact area on the polishing pad 10, the surface dressing ratio (%) is calculated as follows.

$$\text{The surface dressing ratio (\%)}=(n-m)/n\times 100 \quad (13)$$

If the number m is zero, the surface dressing ratio is 100%. The dressing monitoring device 60 has functions to calculate the surface dressing ratio under the dressing conditions which are input to the dressing monitoring device 60, and to display the calculated surface dressing ratio. Furthermore, the dressing monitoring device 60 is configured to generate an alarm signal if the surface dressing ratio is smaller than a predetermined target value. The dressing monitoring device 60 further has functions to determine the dressing conditions that allow the surface dressing ratio to be larger than or equal to the predetermined target value, and to display the determined dressing conditions. Specific factors of the dressing conditions may include the rotational speed of the polishing table 9, the rotational speed of the dresser 5, the oscillating speed of the dresser 5, and the dressing time.

A variation in the sliding distance within the polishing surface 10*a* affects the distribution of the amount of the scraped material of the polishing pad 10, i.e., a profile of the polishing pad 10. It is typically preferable that the sliding distances of the dresser 5 be uniform over the polishing pad 10 in its entirety. Thus, the dressing monitoring device 60 calculates an index, which indicates the variation in the sliding distance in the polishing surface 10*a*, as follows. Where a standard deviation of the sliding distances at the n number of sliding-distance calculate points in the wafer contact area is represented by SDn, and an average of the sliding distances at the n number of sliding-distance calculate points is represented by ADn, a variation index of the sliding distance in the polishing surface 10*a* is given by a following equation.

$$\text{The variation index of the sliding distance}=SDn/ADn \quad (14)$$

The dressing monitoring device 60 has functions to calculate the variation index of the sliding distance under the dressing conditions that are input to the dressing monitoring device 60, and to display the calculated variation index.

If the sliding distances are uniform over the polishing surface 10*a* in its entirety, a flat profile of the polishing pad 10 is obtained. Such a flat profile is expected to contribute to an improvement of the polishing performance of the polishing pad 10 and an improvement of a lifetime of the polishing pad 10. The dressing monitoring device 60 is configured to generate an alarm signal if the variation index of the sliding distance is larger than a predetermined target value. Furthermore, the dressing monitoring device 60 has functions to determine the dressing conditions that allow the variation index of the sliding distance to be less than or equal to the predetermined target value, and to display the determined dressing conditions. Specific factors of the dressing conditions may include the rotational speed of the polishing table 9, the rotational speed of the dresser 5, the oscillating speed of the dresser 5, and the dressing time.

There may be some cases where a non-uniform pad profile is required. For example, a desirable pad profile may be such that a peripheral portion of the polishing pad 10 is thick while a center portion of the polishing pad 10 is thin. In this case, such a profile of the polishing pad 10 can be realized by setting the oscillating speed of the dresser 5 to be slower at the center portion of the polishing pad 10 and be faster at the peripheral portion of the polishing pad 10. The dressing monitoring device 60 can realize a target profile of the polishing pad 10 by adjusting the dressing conditions based on the sliding-distance distribution obtained.

The distribution of the sliding vectors expressed on the polishing surface 10*a* can represents a surface state (or surface condition) of the polishing pad 10 which cannot be obtained only from the sliding-distance distribution. The dressing monitoring device 60 can control the polishing performance of the polishing pad 10 based on the surface state of the polishing pad 10 indicated by the sliding vector distribution. The dressing monitoring device 60 indexes the sliding vector distribution and uses it as follows.

Figure 17:
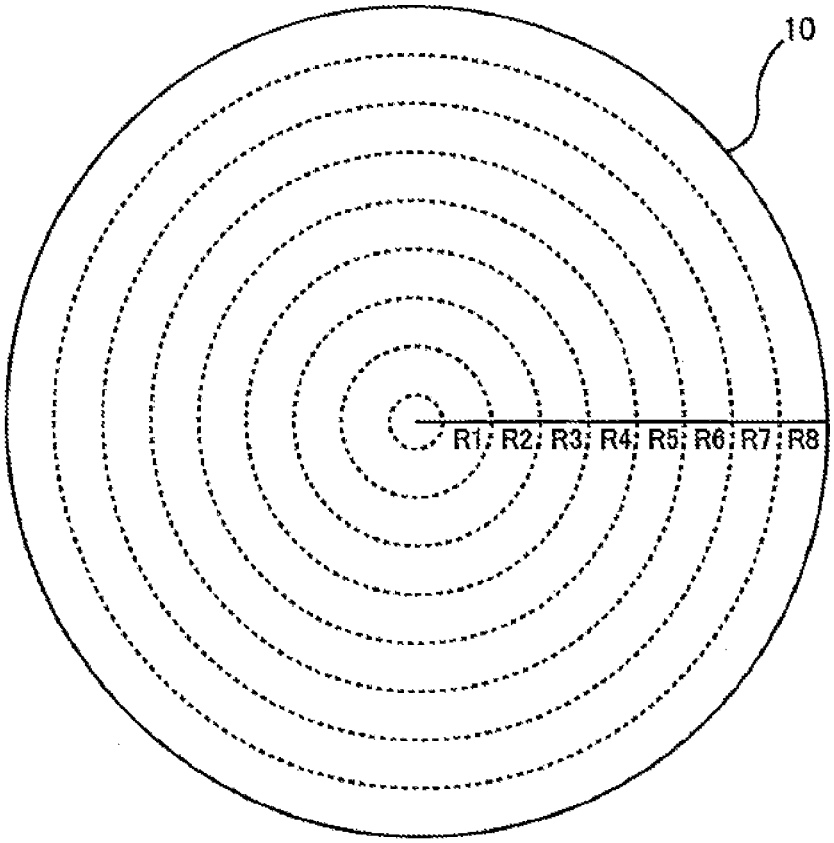
FIG. 17 is a view showing plural concentric annular regions which are defined in advance on the polishing surface of the polishing pad.

FIG. 17 is a view showing plural concentric annular regions which are defined in advance on the polishing surface 10*a* of the polishing pad 10. Widths in a radial direction of these annular regions may be the same as or different from each other. The dressing monitoring device 60 calculates an average sliding vector by averaging the sliding vectors at the sliding-distance calculation points that belong to the annular region at a radial position RX, after the dressing is finished.

Figure 18:
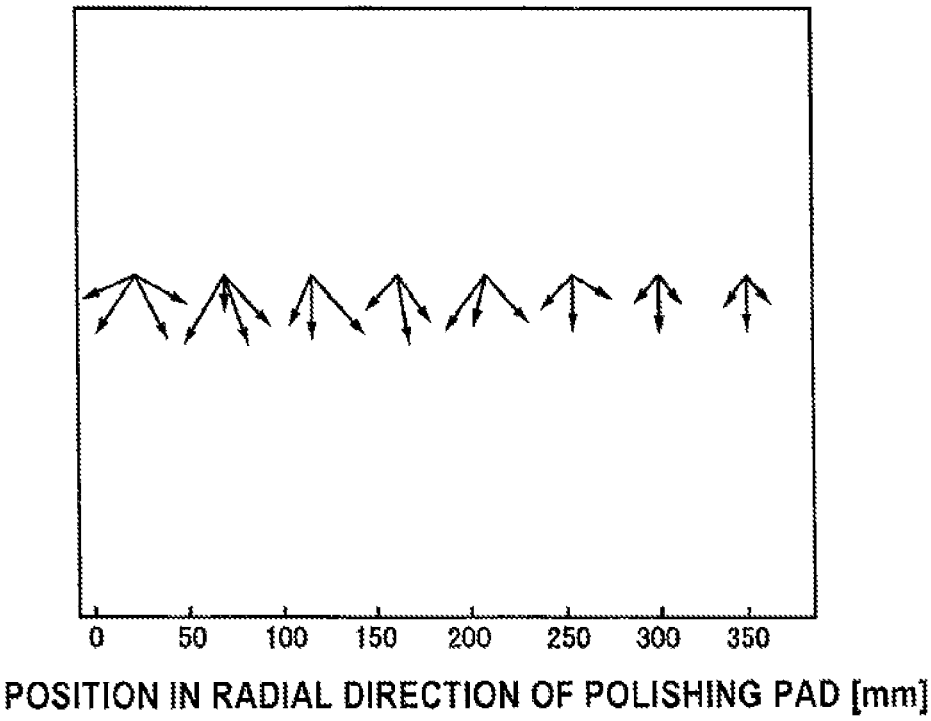
FIG. 18 is a view showing average sliding vectors in each of the plural annular regions.

FIG. 18 is a view showing average sliding vectors in the respective annular regions. As can be seen from FIG. 18, the average sliding vector has, in each of the plural annular regions, the plural sliding distances corresponding to the preset sliding directions. The plural sliding distances, which constitute the average sliding vectors in the plural annular regions, are represented by $DV_{RX,\theta}$. The sign RX represents the radial positions of the n number of annular regions, and is one of R1 through RN. In the example shown in FIG. 18, RX is one of R1, R2, R3, . . . , R8. The sign θ represents the above-described plural sliding directions, which are preset and stored in the dressing monitoring device 60. The sign θ is one of θ1 through θM. $DV_{RX,\theta}$ is an average of the sliding distances with respect to the sliding direction θ obtained at the sliding-distance calculation points which belong to the annular region RX. For example, if the preset sliding directions are θ1, θ2, θ3, . . . , θM, the M number of average sliding distances are calculated in each of the annular regions RX. Depending on the dressing conditions, some of the M number of average sliding distances may be zero.

The dressing monitoring device 60 calculates indexes $I_A$ and $I_B$ which indicate a variation in the distribution of the sliding vectors on the polishing pad 10, from the following equations.

$$I_A=\mathrm{Sig}_{RX}(\mathrm{Ave}_\theta(DV_{RX,\theta})) \quad (15)$$

$$I_B=\mathrm{Ave}_{RX}(\mathrm{Sig}_\theta(DV_{RX,\theta})) \quad (16)$$

$DV_{RX,\theta}$ is the average sliding distance that is associated with a sliding direction θ in an annular region located at a radial position RX. $\mathrm{Ave}_\theta(\ )$ represents an operation of calculating an average of the sliding directions θ=θ1, θ2, . . . , θM. $\mathrm{Sig}_{RX}(\ )$ represents an operation of calculating a standard deviation of the radial positions RX=R1, R2, . . . , RN. $\mathrm{Sig}_\theta(\ )$ represents an operation of calculating a standard deviation of the sliding directions θ=θ1, θ2, . . . , θM. $\mathrm{Ave}_{RX}(\ )$ represents an operation of calculating an average of the radial positions RX=R1, R2, . . . , RN.

It is indicated that the smaller the variation index $I_A$ of the sliding vector distribution is, the more uniform the sliding vectors become over the radial direction of the polishing pad 10. Furthermore, it is indicated that the smaller the variation index $I_B$ of the sliding vector distribution is, the more uniform the sliding vectors become over the preset plural sliding directions stored in the dressing monitoring device 60. The dressing monitoring device 60 has functions to calculate the variation indexes $I_A$ and $I_B$ of the sliding vector distribution under the dressing conditions that are input to the dressing monitoring device 60, and to display the calculated variation indexes $I_A$ and $I_B$. The dressing monitoring device 60 generates an alarm signal if the variation indexes $I_A$ and $I_B$ are larger than target values $A_0$ and $B_0$, respectively. Furthermore, if the variation indexes $I_A$ and $I_B$ are larger than the target values $A_0$ and $B_0$, respectively, the dressing monitoring device 60 determines the dressing conditions that allow the variation indexes of the sliding vector distribution to be less than or equal to the predetermined target value, and to display the determined dressing conditions. Specific factors of the dressing conditions may include the rotational speed of the polishing table 9, the rotational speed of the dresser 5, the oscillating speed of the dresser 5, and the dressing time.

Furthermore, the dressing monitoring device 60 calculates an index indicating an orthogonality of the sliding vectors when one dressing operation is terminated. The orthogonality index of the sliding vectors is an index indicating whether plural vectors, held by the sliding vectors at each sliding-distance calculation point, are directed to a single direction, or directed to orthogonal directions, or closer to any one of them. In one example, the orthogonality index of the sliding vectors is determined as follows. A pair of vectors are selected from the plural sliding vectors at each sliding-distance calculation point. The pair of vectors to be selected are such that a length (or span) of a difference between opposed vectors is maximum. A direction including the selected vectors is defined as axis. Next, a minimum rectangle, in which all of the vectors can be disposed, is defined such that one side of the rectangle is parallel to said axis. A ratio of a short side length to a long side length of the rectangle obtained is defined as the orthogonality index of the vectors.

Figure 19A:
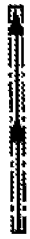
FIG. 19A, FIG. 19B, and FIG. 19C are views for explaining a calculating method of an orthogonality index of the sliding vectors.
Figure 19B:
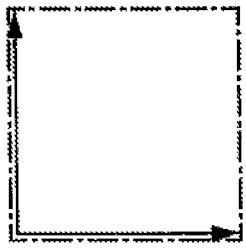
Figure 19C:
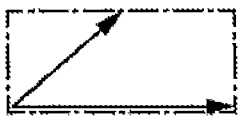

A method of calculating the orthogonality index of the sliding vectors will be described with reference to FIG. 19A through FIG. 19C. FIG. 19A shows an example in which two sliding vectors at a certain sliding-distance calculation point have the same direction. In this example, the minimum rectangle is substantially a line. Therefore, the ratio of the short side length to the long side length is zero. FIG. 19B shows an example in which two sliding vectors at a certain sliding-distance calculation point have the same length and the same direction. In this example, the minimum rectangle is a square. Therefore, the ratio of the short side length to the long side length is 1. FIG. 19C shows an example in which an angle between two sliding vectors at a certain sliding-distance calculation point is an acute angle. In this example, the ratio of the short side length to the long side length is larger than zero and smaller than 1 (in the example shown in FIG. 19C, the ratio is 0.5).

According to this calculation method, when the plural vectors are in the same direction, the orthogonality index is zero. The orthogonality index is gradually larger than 0 toward 1, as the directions of the plural vectors are separated from the same direction. When the plural vectors are in the orthogonal directions and have the same length, the orthogonality index is 1. This can be considered that the distribution of the direction of the dresser sweeping across the pad element is indexed. It is considered that, even if the dressing amount is the same, a manner of dressing the polishing pad, i.e., the surface state of the polishing pad, is different between a case where the dressing is performed only in the same direction and a case where the dressing is performed in multi-directions. With use of the orthogonality index, the dressing conditions can be determined in consideration of such a difference in the manner of dressing the polishing pad. The index representing the distribution of the sliding vectors is not limited to this example of the above-described orthogonality index.

The dressing monitoring device 60 calculates an average orthogonality index by averaging the above-described average sliding vectors along the radial direction of the polishing pad 10. The dressing monitoring device 60 has functions to calculate the average orthogonality index under the dressing conditions that are input to the dressing monitoring device 60, and to display the average orthogonality index. Furthermore, the dressing monitoring device 60 is configured to generate an alarm signal if the average orthogonality index is less than a predetermined target index value. Furthermore, if the average orthogonality index of the sliding vector distribution is less than the predetermined target value, the dressing monitoring device 60 determines the dressing conditions that allow the average orthogonality index to be larger than or equal to the predetermined target value, and to display the determined dressing conditions. Specific factors of the dressing conditions may include the rotational speed of the polishing table 9, the rotational speed of the dresser 5, the oscillating speed of the dresser 5, and the dressing time. The average orthogonality index is used as an index for a producing the surface state (see FIG. 15 and FIG. 16) of the polishing pad 10 which cannot be expressed only by the pad profile and the cutting rate which have been conventionally used as an index of a manner of dressing the polishing pad 10. Furthermore, it is considered that the average orthogonality index is correlated with the surface roughness (measured by the pad roughness measuring device 35) of the polishing pad 10 as a result of the dressing operation.

In the above-described embodiments, the wafer contact area is used as a reference area of the index value as shown in the equation (13). However, the index value may be calculated with use of a contact area of the top ring 20 or a contact area of the dresser 5 as the reference area.

In the above-described embodiment, the dresser pivots around the point J of the dresser pivot shaft as shown in FIG. 2. It is noted that the present invention can be applied to an embodiment in which the dresser performs a linear reciprocating motion and an embodiment in which the dresser performs other motions. In addition, while in the above-described embodiment the polishing member (i.e., the polishing pad) is rotated as shown in FIG. 1, the present invention can be applied to an embodiment in which the polishing member moves like an endless track.

What is claimed is:

1. A method of obtaining a sliding-distance distribution of a dresser sliding on a polishing member for polishing a substrate, the method comprising:

calculating a relative speed between the dresser and the polishing member at a predetermined sliding-distance calculation point on the polishing member;

calculating an increment of a sliding distance of the dresser at the sliding-distance calculation point by multiplying the relative speed by a contact time during which the dresser contacts the polishing member at the sliding-distance calculation point;

correcting the increment of the sliding distance by multiplying the calculated increment of the sliding distance by at least one correction coefficient;

updating the sliding distance by adding the corrected increment of the sliding distance to a current sliding distance at the sliding-distance calculation point; and producing a sliding-distance distribution of the dresser from the updated sliding distance and a position of the sliding-distance calculation point, wherein the at least one correction coefficient includes an unevenness correction coefficient provided for the sliding-distance calculation point, wherein the unevenness correction coefficient is a correction coefficient that allows a profile of the polishing member to reflect a difference between an amount of scraped material of the polishing member in a raised portion and an amount of scraped material of the polishing member in a recess portion, and wherein the correcting of the increment of the sliding distance comprises correcting the increment of the sliding distance by multiplying the increment of the sliding distance by the unevenness correction coefficient.

2. The method according to claim 1, wherein the unevenness correction coefficient is determined by:

calculating an average of sliding distances at plural sliding-distance calculation points that are in contact with the dresser;

calculating a difference by subtracting the average from the sliding distance at the predetermined sliding-distance calculation point that is in contact with the dresser, and inputting the difference into a predetermined function.

3. The method according to claim 1, wherein the at least one correction coefficient further includes a predetermined friction correction coefficient, and the correcting of the increment of the sliding distance further comprises correcting the corrected increment of the sliding distance by multiplying the corrected increment of the sliding distance by the friction correction coefficient, if the dresser contacts the polishing member at the sliding-distance calculation point predetermined times or more while steps from the calculating of the relative speed to the correcting of the increment of the sliding distance are repeated.

4. The method according to claim 1, wherein the at least one correction coefficient further includes a substrate sliding-distance correction coefficient, which is determined by:

calculating a sliding distance of the substrate on the polishing member at the sliding-distance calculation point;

calculating a ratio of the sliding distance of the substrate to the sliding distance of the dresser at the sliding-distance calculation point; and inputting the ratio into a predetermined function.

5. The method according to claim 1, further comprising;

calculating a surface dressing ratio representing a ratio of a dresser contact area to a substrate contact area of the polishing member.

6. The method according to claim 5, further comprising:

determining dressing conditions that allow the surface dressing ratio to be larger than or equal to a predetermined target value.

7. The method according to claim 1, further comprising:

calculating an index indicating a variation in the sliding distance of the dresser in a substrate contact area of the polishing member.

8. The method according to claim 7, further comprising:

determining dressing conditions that allow the index, indicating the variation in the sliding distance of the dresser, to be less than or equal to a predetermined target value.

9. A polishing apparatus, comprising:

a polishing table configured to support a polishing member;

a substrate holder configured to press the substrate against the polishing member to polish the substrate;

a dresser configured to dress the polishing member; and a dressing monitoring device configured to obtain a sliding-distance distribution of the dresser which slides on the polishing member, the dressing monitoring device being configured to calculate a relative speed between the dresser and the polishing member at a predetermined sliding-distance calculation point on the polishing member, calculate an increment of a sliding distance of the dresser at the sliding-distance calculation point by multiplying the relative speed by a contact time during which the dresser contacts the polishing member at the sliding-distance calculation point, correct the increment of the sliding distance by multiplying the calculated increment of the sliding distance by at least one correction coefficient, update the sliding distance by adding the corrected increment of the sliding distance to a current sliding distance at the sliding-distance calculation point, and produce a sliding-distance distribution of the dresser from the updated sliding distance and a position of the sliding-distance calculation point, wherein the at least one correction coefficient includes an unevenness correction coefficient provided for the sliding-distance calculation point, wherein the unevenness correction coefficient is a correction coefficient that allows a profile of the polishing member to reflect a difference between an amount of scraped material of the polishing member in a raised portion and an amount of scraped material of the polishing member in a recess portion, and wherein the dressing monitoring device is configured to correct the increment of the sliding distance by multiplying the increment of the sliding distance by the unevenness correction coefficient.

10. The polishing apparatus according to claim 9, wherein the dressing monitoring device is configured to determine the unevenness correction coefficient by:

calculating an average of sliding distances at plural sliding-distance calculation points that are in contact with the dresser;

calculating a difference by subtracting the average from the sliding distance at the predetermined sliding-distance calculation point that is in contact with the dresser, and inputting the difference into a predetermined function.

11. The polishing apparatus according to 9, wherein the at least one correction coefficient further includes a predetermined friction correction coefficient, and the dressing monitoring device is configured to correct the corrected increment of the sliding distance by multiplying the corrected increment of the sliding distance by the friction correction coefficient, if the dresser contacts the polishing member at the sliding-distance calculation point predetermined times or more while steps from the calculating of the relative speed to the correcting of the increment of the sliding distance are repeated.

12. The polishing apparatus according to claim 9, wherein the at least one correction coefficient further includes a substrate sliding-distance correction coefficient, and the dressing monitoring device is configured to determine the substrate sliding-distance correction coefficient by:

calculating a sliding distance of the substrate on the polishing member at the sliding-distance calculation point;

calculating a ratio of the sliding distance of the substrate to the sliding distance of the dresser at the sliding-distance calculation point; and inputting the ratio into a predetermined function.

13. The polishing apparatus according to claim 9, wherein the dressing monitoring device is configured to calculate a surface dressing ratio representing a ratio of a dresser contact area to a substrate contact area of the polishing member.

14. The polishing apparatus according to claim 13, wherein the dressing monitoring device is configured to determine dressing conditions that allow the surface dressing ratio to be larger than or equal to a predetermined target value.

15. The polishing apparatus according to claim 9, wherein the dressing monitoring device is configured to calculate an index indicating a variation in the sliding distance of the dresser in a substrate contact area of the polishing member.

16. The polishing apparatus according to claim 15, wherein the dressing monitoring device is configured to determine dressing conditions that allow the index, indicating the variation in the sliding distance of the dresser, to be less than or equal to a predetermined target value.

17. A method of obtaining a sliding vector distribution of a dresser which slides on a polishing member for polishing a substrate, the method comprising:

calculating a relative speed between the dresser and the polishing member at a predetermined sliding-distance calculation point on the polishing member;

calculating an increment of a sliding distance of the dresser at the sliding-distance calculation point by multiplying the relative speed by a contact time during which the dresser contacts the polishing member at the sliding-distance calculation point;

correcting the increment of the sliding distance by multiplying the calculated increment of the sliding distance by at least one correction coefficient;

calculating a sliding direction of the dresser at the sliding-distance calculation point;

selecting one of preset plural sliding directions based on the calculated sliding direction;

producing a sliding vector by adding the corrected increment of the sliding distance to a current sliding distance associated with the selected direction at the sliding-distance calculation point to update the sliding distance; and producing the sliding vector distribution of the dresser from the sliding vector and a position of the sliding-distance calculation point.

18. The method according to claim 17, further comprising:

calculating an index which indicates a variation in the sliding vector in a substrate contact area of the polishing member.

19. The method according to claim 18, further comprising:

determining dressing conditions that allow the index, indicating the variation in the sliding vector, to be less than or equal to a predetermined target value.

20. The method according to claim 17, further comprising:

calculating an index which indicates an orthogonality of sliding vectors in the substrate contact area of the polishing member.

21. The method according to claim 20, further comprising:

determining the dressing conditions that allow the index, indicating the orthogonality of the sliding vectors, to be larger than or equal to a predetermined target value.

22. A polishing apparatus, comprising:

a polishing table configured to support a polishing member;

a substrate holder configured to press the substrate against the polishing member to polish the substrate;

a dresser configured to dress the polishing member; and a dressing monitoring device configured to obtain a sliding vector distribution of the dresser which slides on the polishing member, the dressing monitoring device being configured to calculate a relative speed between the dresser and the polishing member at a predetermined sliding-distance calculation point on the polishing member, calculate an increment of a sliding distance of the dresser at the sliding-distance calculation point by multiplying the relative speed by a contact time during which the dresser contacts the polishing member at the sliding-distance calculation point, correct the increment of the sliding distance by multiplying the calculated increment of the sliding distance by at least one correction coefficient, calculate a sliding direction of the dresser at the sliding-distance calculation point, select one of preset plural sliding directions based on the calculated sliding direction, produce a sliding vector by adding the corrected increment of the sliding distance to a current sliding distance associated with the selected direction at the sliding-distance calculation point to update the sliding distance, and produce the sliding vector distribution of the dresser from the sliding vector and a position of the sliding-distance calculation point.

23. The polishing apparatus according to claim 22, wherein the dressing monitoring device is configured to calculate an index which indicates a variation in the sliding vector in a substrate contact area of the polishing member.

24. The polishing apparatus according to claim 22, wherein the dressing monitoring device is configured to determine dressing conditions that allow the index, indicating the variation in the sliding vector, to be less than or equal to a predetermined target value.

25. The polishing apparatus according to claim 22, wherein the dressing monitoring device is configured to calculate an index which indicates an orthogonality of sliding vectors in the substrate contact area of the polishing member.

26. The polishing apparatus according to claim 25, wherein the dressing monitoring device is configured to determine the dressing conditions that allow the index, indicating the orthogonality of the sliding vectors, to be larger than or equal to a predetermined target value.

* * * * *